US008596763B2

(12) United States Patent
Sugahara

(10) Patent No.: US 8,596,763 B2
(45) **Date of Patent: *Dec. 3, 2013**

(54) LIQUID DROPLET TRANSPORT APPARATUS

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1172 days.

This patent is subject to a terminal disclaimer.

(21) Appl. No.: 11/860,141

(22) Filed: Sep. 24, 2007

(65) Prior Publication Data

US 2008/0186365 A1 Aug. 7, 2008

(30) Foreign Application Priority Data

Sep. 25, 2006 (JP) ..... 2006-258489

(51) Int. Cl.
*B41J 2/04* (2006.01)

(52) U.S. Cl.
USPC ..... 347/54; 347/55

(58) Field of Classification Search
USPC ..... 347/54, 55
See application file for complete search history.

(56) References Cited

U.S. PATENT DOCUMENTS 5,157,418 A 10/1992 Tamura
6,132,031 A 10/2000 Watanabe
7,422,311 B2 * 9/2008 Sugahara ..... 347/54
7,780,268 B2 * 8/2010 Sugahara ..... 347/54
2005/0219330 A1 10/2005 Sugahara

FOREIGN PATENT DOCUMENTS

JP 2078555 A 3/1990
JP 10235865 A 9/1998
JP 2003136726 A 5/2003
JP 2005-199231 A 7/2005
JP 2005-288875 A 10/2005

OTHER PUBLICATIONS

Notice of Reasons for Rejection for Japanese patent application No. 2006-258489 mailed Jun. 5, 2012.
Notice of Reasons for Rejection for Japanese patent application No. 2006-258489 mailed Jan. 24, 2012.

* cited by examiner

*Primary Examiner* — Kevin S Wood
(74) *Attorney, Agent, or Firm* — Banner & Witcoff, Ltd.

(57) ABSTRACT

A liquid transport apparatus includes a substrate, liquid transport channels disposed on a surface of the substrate in which a conductive liquid is transported, electrodes disposed in regions in corresponding ones of the liquid transport channels, and wiring portions coupled to corresponding electrodes and extending along the surface of the substrate between adjacent liquid transport channels. Also, the apparatus includes an insulating layer which is disposed so as to cover the electrodes. The insulating layer has a surface in which the liquid repellency changes according to an electrical potential difference between the conductive liquid and the electrodes. The apparatus also has a potential applying unit which applies an electric potential to each of the electrodes through terminals at the ends of the wiring portions.

10 Claims, 19 Drawing Sheets

LIQUID DROPLET TRANSPORT APPARATUS

CROSS REFERENCE TO RELATED APPLICATION

The present application claims priority from Japanese Patent Application No. 2006-258489, filed on Sep. 25, 2006, the disclosure of which is incorporated herein by reference in its entirety.

BACKGROUND

Aspects of the present invention relate to a liquid transport apparatus which transports a liquid.

In a printer which records an image or the like by discharging ink onto a recording medium, such as a recording sheet, an ink-jet recording head which ejects ink from nozzles toward the recording medium is generally employed. However, in such an ink-jet recording head, the structure of a flow passage for generating ink ejection pressure and the structure of an actuator are special and complicated. As a result, there is a limitation in reducing the size of the recording head by arranging nozzles in a high density relationship.

Accordingly, a recording head of a new type has been proposed using an electrowetting phenomenon in which, when an electrode potential is changed in a state where the surface of an electrode is covered with an insulating layer, the liquid repellency (wetting angle) at the surface of the insulating layer changes . The recording head includes individual flow passages each composed of a recess. An individual electrode is provided on each individual flow passage (on the bottom face of the recess), and the surface of the individual electrode is covered with an insulating layer. Ink disposed in the head is in contact with a common electrode which is maintained at ground potential, and the electric potential of the ink is always set at ground potential. A pump, which pressurizes the ink toward a discharge port located at the end of the individual flow passage, is also provided on the upstream side of the individual flow passage.

When the electric potential of the individual electrode is set at the ground potential and there is no electrical potential difference between the ink and the individual electrode, the liquid repellency (wetting angle) at the surface of the insulating layer interposed between the ink and the individual electrode becomes high when compared with a region of the bottom face of the recess not provided with the insulating layer. Consequently, the ink is not allowed to pass over the surface of the insulating layer and flow toward the discharge port, and the ink is not discharged from the discharge port. On the other hand, when the electrical potential of the individual electrode is switched to a predetermined electrical potential that is different from the ground potential, an electrical potential difference occurs between the ink and the individual electrode. As a result, the liquid repellency (wetting angle) at the surface of the insulating layer interposed between the ink and the individual electrode is decreased causing the electrowetting phenomenon. Consequently, the ink pressurized by the pump is allowed to wet the surface of the insulating layer and move toward the discharge port, and the ink is discharged from the discharge port.

SUMMARY

Illustrative aspects of the present invention relate to a liquid transport apparatus. The apparatus may include a substrate having a planar insulating surface, liquid transport channels which are disposed on the planar insulating surface of the substrate and in each of which a conductive liquid is transported, and electrodes having a surface contacting and disposed on the planar insulating surface of the substrate in regions corresponding to respective ones of the liquid transport channels. Also included can be wiring portions each having a terminal at an end thereof. Each wiring portion can be coupled to the surface of a corresponding one of the electrodes and extending from the surface along the planar insulating surface of the substrate between adjacent liquid transport channels to the terminal. Further, an insulating layer may be provided which is disposed so as to cover the electrodes, having a surface in which the liquid repellency changes according to an electrical potential difference between the conductive liquid and the electrodes. The apparatus may also include a potential applying unit which applies an electric potential to each of the electrodes through each terminal provided on the wiring portions.

DETAILED DESCRIPTION

It is noted that various connections are set forth between elements in the following description. It is noted that these connections in general and, unless specified otherwise, may be direct or indirect and that this specification is not intended to be limiting in this respect.

Figure 1:
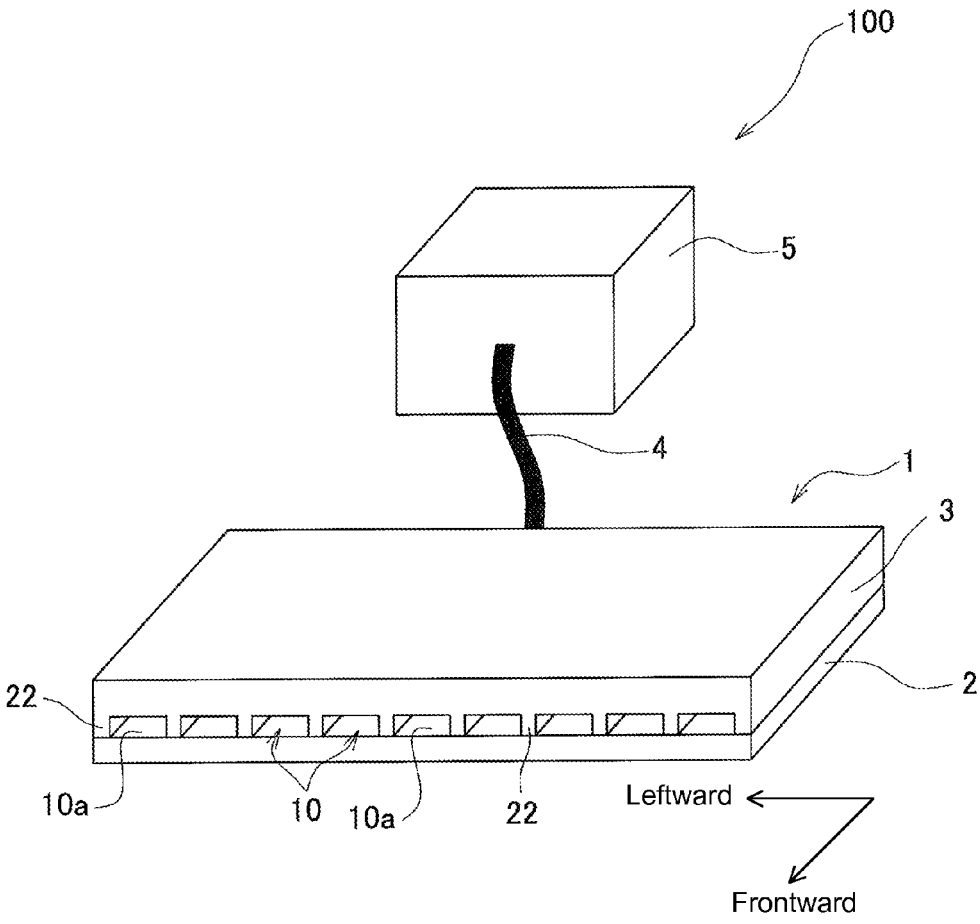
FIG. 1 is an illustration schematically showing a structure of a printer according to a first illustrative embodiment of the present invention.

A first illustrative embodiment of the present invention will be described below with reference to the drawings. The first illustrative embodiment relates to an example which is applied to an image forming device, such as a printer that performs printing by transporting a liquid, which in this example is an ink, to a recording sheet. FIG. 1 is an illustration schematically showing a structure of a printer according to the first illustrative embodiment. As shown in FIG. 1, a printer 100 includes a liquid transport apparatus, for example an ink transport head 1 which includes liquid transport channels such as individual ink flow passages 10 each having a discharge port 10*a*, and an ink tank 5 which is connected to the ink transport head 1 by a tube 6. The printer 100 records a desired image by discharging ink from the discharge ports 10*a* of the ink transport head 1 toward a recording sheet P (refer to FIGS. 5A and 5B). The ink used in the printer 100 is a conductive ink, such as a water-based dye ink containing water as a main component, and a dye and a solvent added thereto, or a water-based pigment ink containing water as a main component, and a pigment and a solvent added thereto. Hereinafter, front-back and left-right directions are respectively defined as shown in FIG. 1.

Figure 2:
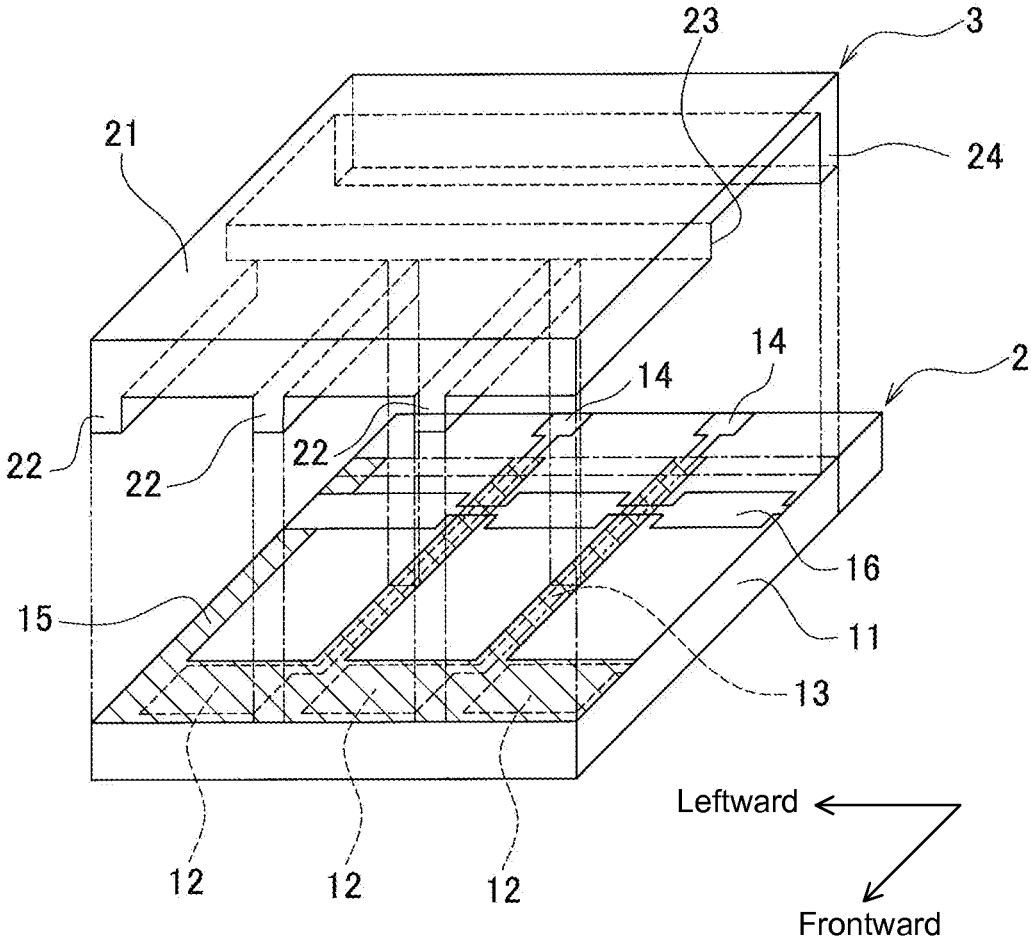
FIG. 2 is an exploded perspective view showing a part of an ink transport head shown in FIG. 1.
Figure 3:
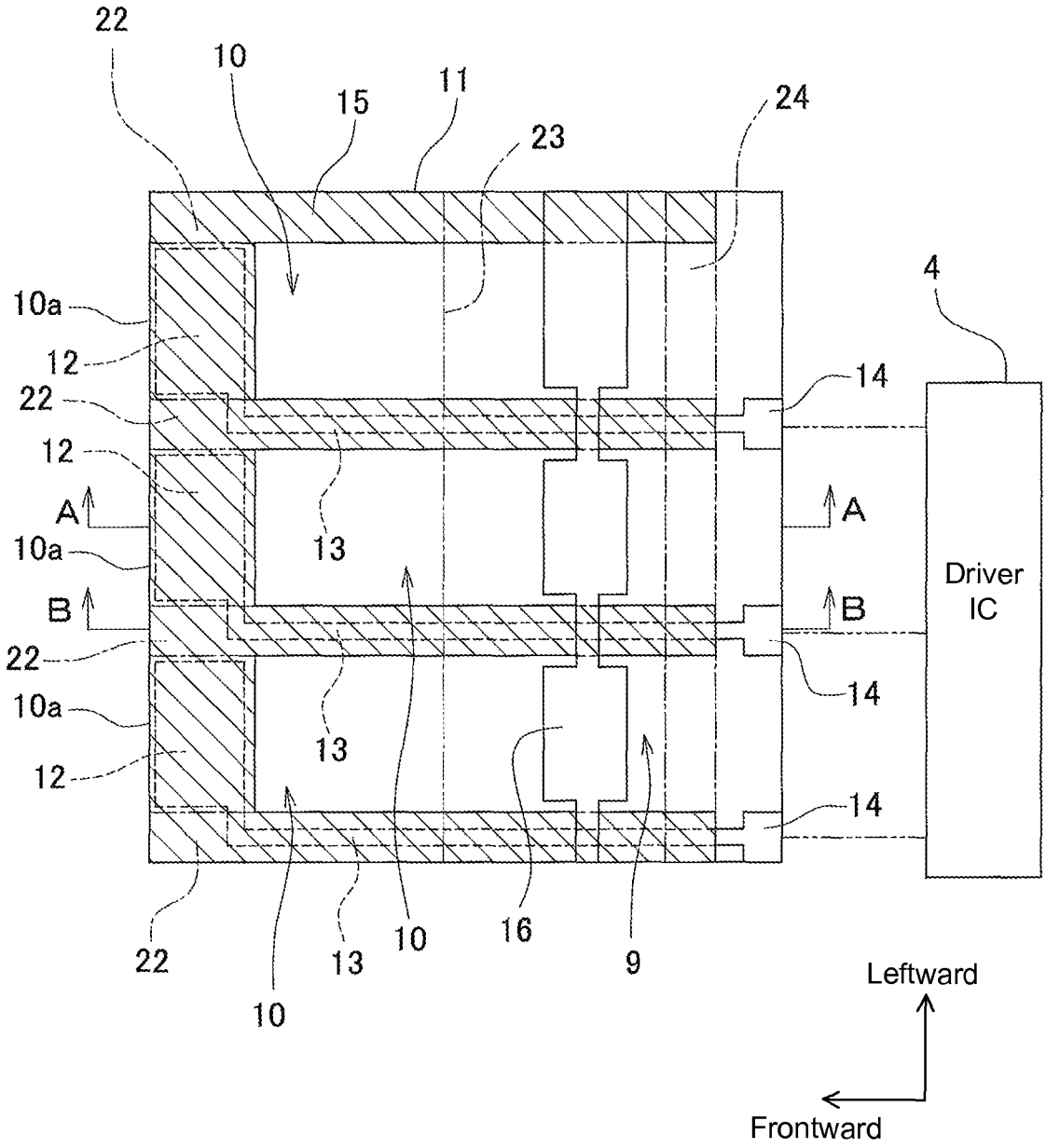
FIG. 3 is a plan view showing the ink transport head shown in FIG. 2.
Figure 4A:
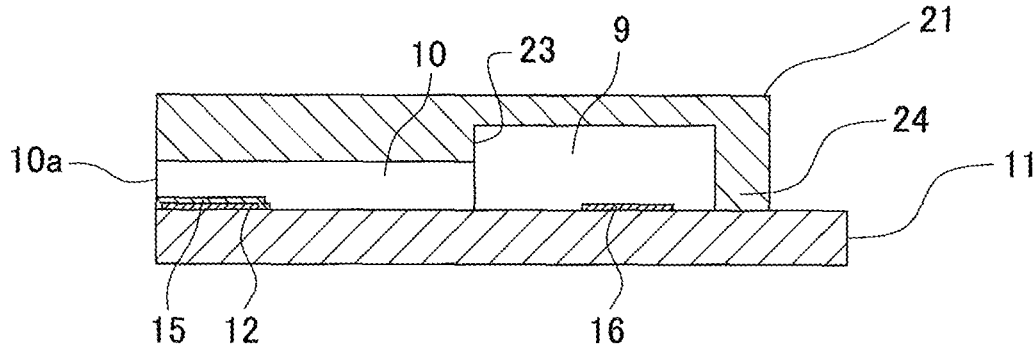
FIG. 4A is a sectional view taken along the line A-A of FIG. 3.
Figure 4B:
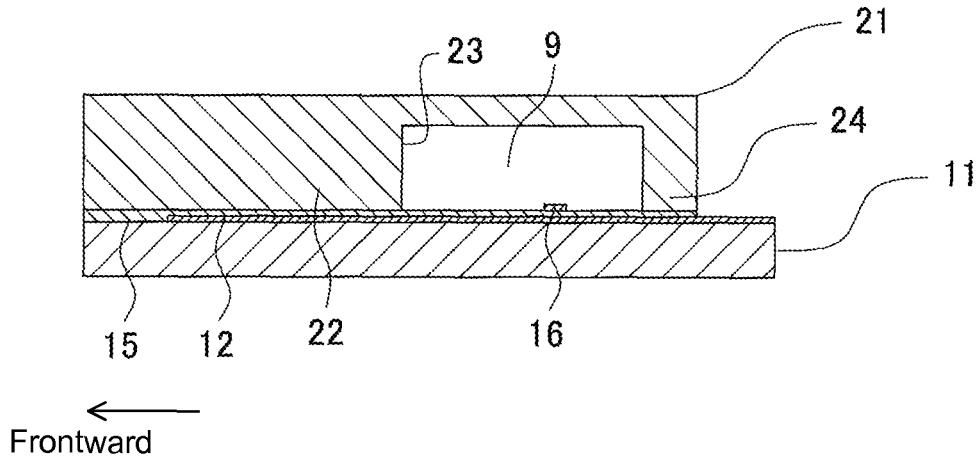
FIG. 4B is a sectional view taken along the line B-B of FIG. 3.

FIG. 2 is an enlarged, exploded perspective view showing a part of the ink transport head 1 shown in FIG. 1. FIG. 3 is a plan view of FIG. 2. FIG. 4A is a sectional view taken along the line A-A of FIG. 3, and FIG. 4B is a sectional view taken along the line B-B of FIG. 3. As shown in FIGS. 1 to 4B, the ink transport head 1 may include a lower member 2 constituting a substantially lower half portion and an upper member 3 constituting a substantially upper half portion, the lower member 2 and the upper member 3 being bonded to each other. In the ink transport head 1, a common ink flow passage 9 extends in the left-right direction, and individual ink flow passages 10 branched from the common ink flow passage 9 extend to the front side, the individual ink flow passages 10 being spaced a predetermined distance apart from each other in the left-right direction.

The common ink flow passage 9 is disposed on the upstream side of (i.e., at the back of) the individual ink flow passages 10, and communicates with all of the individual ink flow passages 10. The common ink flow passage 9 is connected to the ink tank 5 by the tube 6. The ink is supplied from the ink tank 5 to the common ink flow passage 9, and is further supplied from the common ink flow passage 9 to the individual ink flow passages 10. The ink tank 5 is disposed at a position slightly higher than the common ink flow passage 9, and under the influence of the back pressure from the ink tank 5, the ink flows in the common ink flow passage 9 toward the discharge ports 10*a*. According to such an arrangement, since the ink transport head 1 includes the individual ink flow passages 10 and the common ink flow passage 9 which communicates with the individual ink flow passages 10, it is possible to supply the ink easily to the individual ink flow passages 10 by supplying the ink from the ink tank 5 to the common ink flow passage 9.

The lower member 2 and the upper member 3 constituting the ink transport head 1 will now be described.

The lower member 2 includes individual electrodes 12, wiring portions 13, terminals 14, an insulating layer 15, and a common electrode 16 disposed on an upper surface of a substrate 11. The substrate 11 is a plate-like body which has a substantially rectangular planar shape and which is composed of an insulating material, such as silicon or polyimide. The individual electrodes 12 each have a substantially rectangular planar shape and are disposed a predetermined distance apart from each other in the left-right direction on the front end of the substrate 11 in the regions of the individual ink flow passages 10 so as to correspond to the individual ink flow passages 10.

Each of the wiring portions 13 extends rightward from the right back corner of the corresponding individual electrode 12 to a region between the corresponding individual electrode and an immediately adjacent individual electrode 12. Each wiring portion 13 is bent substantially at a right angle toward the back of the substrate 11, passes through a region between adjacent individual ink flow passages 10 on the upper surface of the substrate 11, and a region corresponding to a bottom face of the common ink flow passage 9, and extends to a terminal 14 disposed on a back end of the substrate 11. Since the wiring portions 13 are disposed between the individual ink flow passages 10, the ink in the individual ink flow passages 10 is prevented from being brought into contact with the individual electrodes 12.

The terminals 14 are disposed on the back end of the substrate 11 in regions corresponding to the regions between the individual ink flow passages 10 with respect to the left-right direction, and each has a substantially rectangular planar shape. The terminals 14 are connected to a driver IC 4 functioning as a potential applying unit. Other potential applying units known to one skilled in the art may be employed. A drive potential V1 or a ground potential is selectively applied by the driver IC 4 to each of the individual electrodes 12 through the terminals 14 and the wiring portions 13. According to such an arrangement, since the wiring portions 13 extend toward the upstream side in the transport direction of the ink in the individual ink flow passages 10 and the terminals 14 are disposed on the back end of the substrate 11, even when many individual electrodes 12 are highly integrated, it is possible to perform connection to the driver IC 4 by the terminals 14 disposed on the back end of the substrate 11. Note that the driver IC 4 may be disposed on the back end of the upper surface of the substrate 11 and not directly connected to the terminals 14, and may be connected to the terminals 14 through a flexible printed circuit board (FPC) or the like (not shown).

The individual electrodes 12, the wiring portions 13, and the terminals 14 are each composed of a conductive material, such as a metal, and can be formed by screen-printing, sputtering, vapor deposition, or the like. The individual electrodes 12, the wiring portions 13, and the terminals 14 are disposed on the upper surface of the substrate 11, which is planar. As such, these components can be connected to each other on the upper surface of the substrate 11. Consequently, it is not necessary to form through-holes in the substrate 11 in order to connect these components to each other. Thus, the structure of the ink transport head 1 can be simplified, and the manufacturing cost can be reduced. Furthermore, since all of the individual electrodes 12, the wiring portions 13, and the terminals 14 are disposed on the upper surface of the substrate 11, these components can be formed at one time by the method described above.

According to the arrangement described above, on the upper surface of the substrate 11, the individual electrodes 12 are disposed on the front end along the left-right direction, the terminals 14 are disposed on the back end along the left-right direction, and the wiring portions 13 which connect the individual electrodes 12 to the terminals 14 are disposed, parallel to the individual ink flow passages 10, between the adjacent individual ink flow passages 10. Therefore, the arrangement of the individual electrodes 12, the wiring portions 13, and the terminals 14 is simple.

The insulating layer 15 is composed of an insulating material, such as a fluorocarbon resin, that is different from the substrate 11. The insulating layer 15 extends in the left-right direction at the front end on the upper surface of the substrate 11 so as to cover the individual electrodes 12 and also extends from the front end to the vicinity of the back end in regions overlapping the regions located between adjacent individual ink flow passages 10 with respect to the left-right direction so as to cover the regions between the adjacent individual ink flow passages 10 and wiring portions 13 passing through the common ink flow passage 9. The insulating layer 15 does not extend to regions that overlap the terminals 14, and the terminals 14 are exposed at the surface of the substrate 11. Consequently, the terminals 14 can be easily connected to the driver IC 4. According to such an arrangement, since the wiring portions 13 are covered with the insulating layer 15, the wiring portions 13 are prevented from being brought into contact with the ink in the individual ink flow passages 10 and the common ink flow passage 9. Consequently, the wiring portions 13 can be arranged so as to pass through the common ink flow passage 9, and it is not necessary to arrange the wiring portions 13 to avoid the common ink flow passage 9. As a result, more arrangement configurations may exist.

The insulating layer 15 is formed by a method in which an insulating material is applied by spin coating to the entire region of the upper surface of the substrate 11, and then unnecessary portions are removed by a laser. Alternatively, a method may be employed in which a mask is applied to the upper surface of the substrate 11 except for a portion on which the insulating layer 15 is to be formed, and the insulating layer 15 is formed by CVD, or a method may be employed in which an insulating material is coated on the upper surface of the substrate 11 to form the insulating layer 15.

The common electrode 16 extends in the left-right direction in a region corresponding to the bottom face or surface of the common ink flow passage 9, slightly at the back of a central portion with respect to front-back direction of the upper surface of the substrate 11 on which the insulating layer 15 is disposed. In sections where the common electrode 16 overlaps the insulating layer 15 covering wiring portions 13 in a plan view (i.e., sections where the common electrode 16 intersects with the wiring portions 13 with the insulating layer 15 therebetween), the length of the common electrode 16 with respect to the front-back direction (i.e., the length or width in the extending direction of the wiring portion 13) is less than the length of the common electrode in the direction in sections where the wiring portions 13 do not intersect with the common electrode 16. In the other sections, the common electrode 16 extends with a larger, predetermined width. According to such an arrangement, the area of the sections where the common electrode 16 intersects with the wiring portions 13 with the insulating layer 15 therebetween is decreased, and thus it is possible to minimize the capacitance of a section in which the insulating layer 15 is interposed between each wiring portion 13 and the common electrode 16. Furthermore, the common electrode 16 is connected to the driver IC 4 at a position not shown, and the common electrode 16 is maintained at ground potential by the driver IC 4. Thus, the ink in the common ink flow passage 9 and the ink in the individual ink flow passages 10 which communicate with the common ink flow passage 9 are maintained at ground potential. The common electrode 16 is composed of the same conductive material as that of each of the individual electrodes 12, the wiring portions 13, and the terminals 14 and similarly can be formed by screen-printing, sputtering, vapor deposition, or the like.

The upper member 3 includes partition walls 22, a recess 23, and a partition wall 24 disposed on a substrate 21. The substrate 21 is a plate-like body which is composed of an insulating material, such as polyimide, polyamide, polyacetal, or polyphenylene sulfide, and which has a substantially rectangular planar shape with a length with respect to the front-back direction being slightly smaller than that of the substrate 11. Since the substrate 21 is not in contact with electrodes, the substrate 21 is not necessarily composed of an insulating material, and may be composed of an insulating material.

The partition walls 22 protrude downward from regions of the lower surface of the substrate 21 overlapping regions between adjacent individual ink flow passages 10 in a plan view, and extend from the front end of the substrate 21 in the front-back direction to the substantial center with respect to the front-back direction. When the lower member 2 and the upper member 3 are bonded to each other, spaces surrounded by the upper surface of the substrate 11, the lower surface of the substrate 21, and the partition walls 22 serve as the individual ink flow passages 10. Each of the two adjacent individual ink flow passages 10 is separated by a partition wall 22. In such a case, the partition walls 22 are bonded to the regions overlapping the regions between the adjacent individual ink flow passages 10 in a plan view, and cover the wiring portions 13 covered with the insulating layer 15. Thus, it is possible to prevent the ink in the individual ink flow passages 10 from being brought into contact with the wiring portions 13.

The recess 23 extends on the lower surface of the substrate 21 in a region between a central portion with respect to the front-back direction and the back end of the substrate 21, in the left-right direction with a length substantially equal to the overall length of the substrate 21. When the lower member 2 and the upper member 3 are bonded to each other, a space surrounded by the upper surface of the substrate 11 and the recess 23 serves as the common ink flow passage 9. The partition wall 24 protrudes downward from the back end of the lower surface of the substrate 21 to a position at the same level as the lower end of each partition wall 22 and extends with a length substantially equal to the overall length of the substrate 21 with respect to the left-right direction.

The operations of the ink transport head 1 will now be described with reference to FIGS. 5A and 5B, which are sectional views each showing an operation of the ink transport head 1.

In the ink transport head 1, when an electrical potential difference occurs between the individual electrode 12 and the ink in the individual ink flow passage 10, the wetting angle of the ink (liquid repellency) at the insulating layer 15 in a region facing the corresponding individual electrode 12 changes according to the electrical potential difference (electrowetting phenomenon). More particularly, the relationship $$\cos\theta V=\cos\theta 0+\tfrac{1}{2}\times[(\in\times\in 0)/(\gamma\times t)]\times V2$$

is satisfied, where θV is the wetting angle of the insulating layer 15 when the electrical potential difference V occurs between the individual electrode 12 and the ink in the individual ink flow passage 10, θ0 is the wetting angle of the insulating layer 15 when no electrical potential difference occurs between the individual electrode 12 and the ink in the individual ink flow passage 10, ∈ is the relative dielectric constant of the insulating layer 15, ∈0 is the dielectric constant of a vacuum, γ is the surface tension at the gas-liquid interface, and t is the thickness of the insulating layer 15. Consequently, as the electrical potential difference V between the individual electrode 12 and the ink in the individual ink flow passage 10 increases, cosθV increases. That is, θV decreases, and the liquid repellency at the surface of the insulating layer 15 decreases.

Figure 5A:
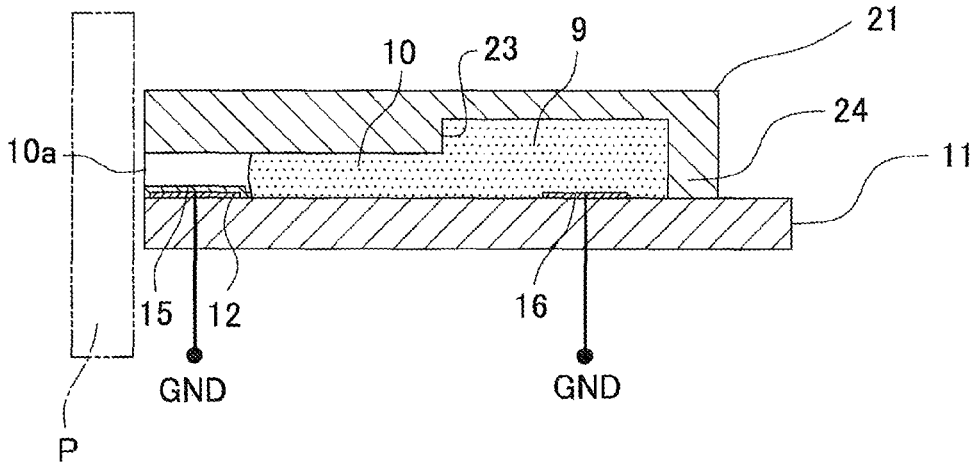
FIGS. 5A and 5B are sectional views each showing an operation of the ink transport head shown in FIG. 2.

In the ink transport head 1, when the ink is not discharged from the discharge port 10*a*, as shown in FIG. 5A, a ground potential is applied to the individual electrode 12, and there is no electrical potential difference between the individual electrode 12 and the ink in the individual ink flow passage 10, the ink being maintained at ground potential. At this time, the wetting angle of the ink on the surface of the insulating layer 15 is larger than the wetting angle of the ink on the upper surface of the substrate 11 and is larger than a wetting angle (critical wetting angle) of the insulating layer 15 at which the ink can move from a portion of the individual ink flow passage 10 where the substrate 11 is exposed to a portion of the individual ink flow passage 10 where the insulating layer 15 is disposed. Consequently, the meniscus of the ink in the individual ink flow passage 10 stops at an edge of the insulating layer 15 along the substrate 11, and the ink does not flow into a portion of the individual ink flow passage 10 facing the insulating layer 15. Thus, the ink is not discharged from the discharge port 10*a*. Note that the critical wetting angle is determined according to the surface tension of the ink, the difference in the wetting angle with respect to the ink between the substrate 11 and the insulating layer 15, the structures of the common ink flow passage 9 and the individual ink flow passage 10, the magnitude of the back pressure of the ink flowing from the ink tank 5 into the common ink flow passage 9, and the like.

Figure 5B:
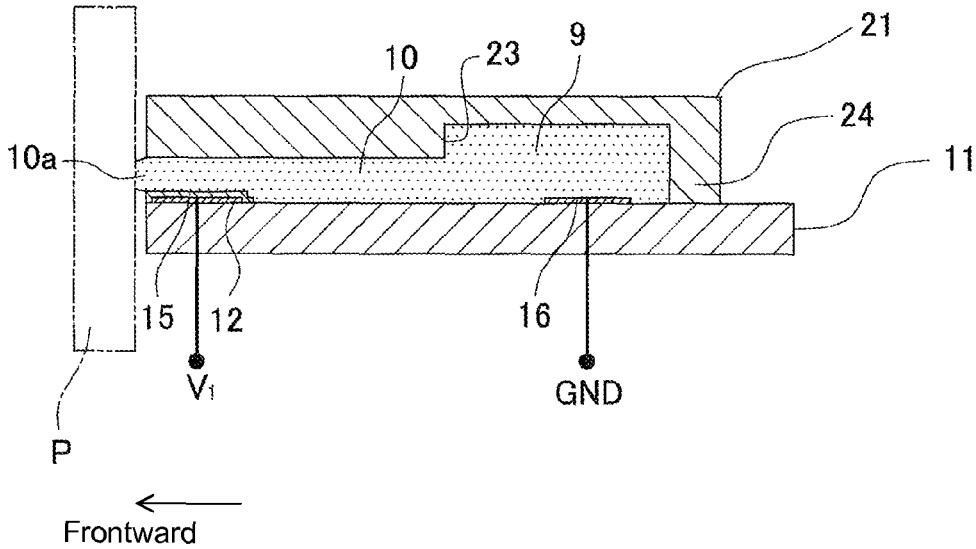

On the other hand, when the ink is discharged from the discharge port 10*a*, as shown in FIG. 5B, a drive potential V1 is applied to the individual electrode 12. As a result, an electrical potential difference occurs between the individual electrode 12 and the ink in the individual ink flow passage 10, and as described above, the wetting angle of the ink at the surface of the insulating layer 15 is decreased to a value equal to or less than the critical wetting angle. Consequently, the ink flows into a portion of the individual ink flow passage 10 facing the insulating layer 15, and the ink is discharged from the discharge port 10*a* to a recording sheet P. At this time, since the ink in the individual ink flow passage 10 is maintained at ground potential by the common electrode 16, the electrical potential difference between the ink in the individual ink flow passage 10 and the individual electrode 12 does not easily change, thus enabling stable operation.

According to the first illustrative embodiment described above, since all of the individual electrodes 12, the wiring portions 13, and the terminals 14 are disposed on the upper surface of the substrate 11, these components can be connected to each other on the upper surface of the substrate 11. Consequently, it is not necessary to form through-holes in the substrate 11. Thus, it is possible to simplify the structure of the ink transport head 1, and the manufacturing cost can be reduced.

Furthermore, since the wiring portions 13 extend through the regions between the individual ink flow passages 10 to the terminals 14, the ink in the individual ink flow passages 10 can be prevented from being brought into contact with the wiring portions 13.

Furthermore, since the wiring portions 13 are covered with the insulating layer 15, it is possible to reliably prevent the ink in the individual ink flow passages 10 from being brought into contact with the wiring portions 13. Moreover, since the wiring portions 13 pass through the common ink flow passage 9 and the insulating layer 15 covers the wiring portions 13 also in this region, it is possible to prevent the ink in the common ink flow passage 9 from being brought into contact with the wiring portions 13.

Furthermore, the individual ink flow passages 10 are separated by the partition walls 22, and the wiring portions 13 are covered with the partition walls 22. Thus, it is possible to prevent the ink from being brought into contact with the wiring portions 13.

Furthermore, the common ink flow passage 9 is disposed in the ink transport head 1, and the ink is supplied from the common ink flow passage 9 to the individual ink flow passages 10. Consequently, by supplying the ink from the ink tank 5 through the tube 6 to the common ink flow passage 9, it is possible to easily supply the ink to the individual ink flow passages 10.

Furthermore, since the common electrode 16 is disposed in the common ink flow passage 9, the ink in the common ink flow passage 9 and the ink in the individual ink flow passages 10 can be maintained at ground potential. Consequently, the electrical potential difference between the ink and the individual electrodes 12 does not easily change, thus enabling stable operation.

Furthermore, since the width of the common electrode 16 is narrower in the sections where the common electrode 16 intersects with the wiring portions 13, the area of the sections where the common electrode 16 overlaps the wiring portions 13 is decreased. Thus, it is possible to reduce the capacitance in a section in which the insulating layer 15 is interposed between each wiring portion 13 and the common electrode 16.

Modified illustrative embodiments in which various modifications are made to the above illustrative embodiment will be described below. The same reference numerals are used to designate components having a similar structure as the structure of the components in the above illustrative embodiment, and the descriptions thereof are omitted.

Figure 6:
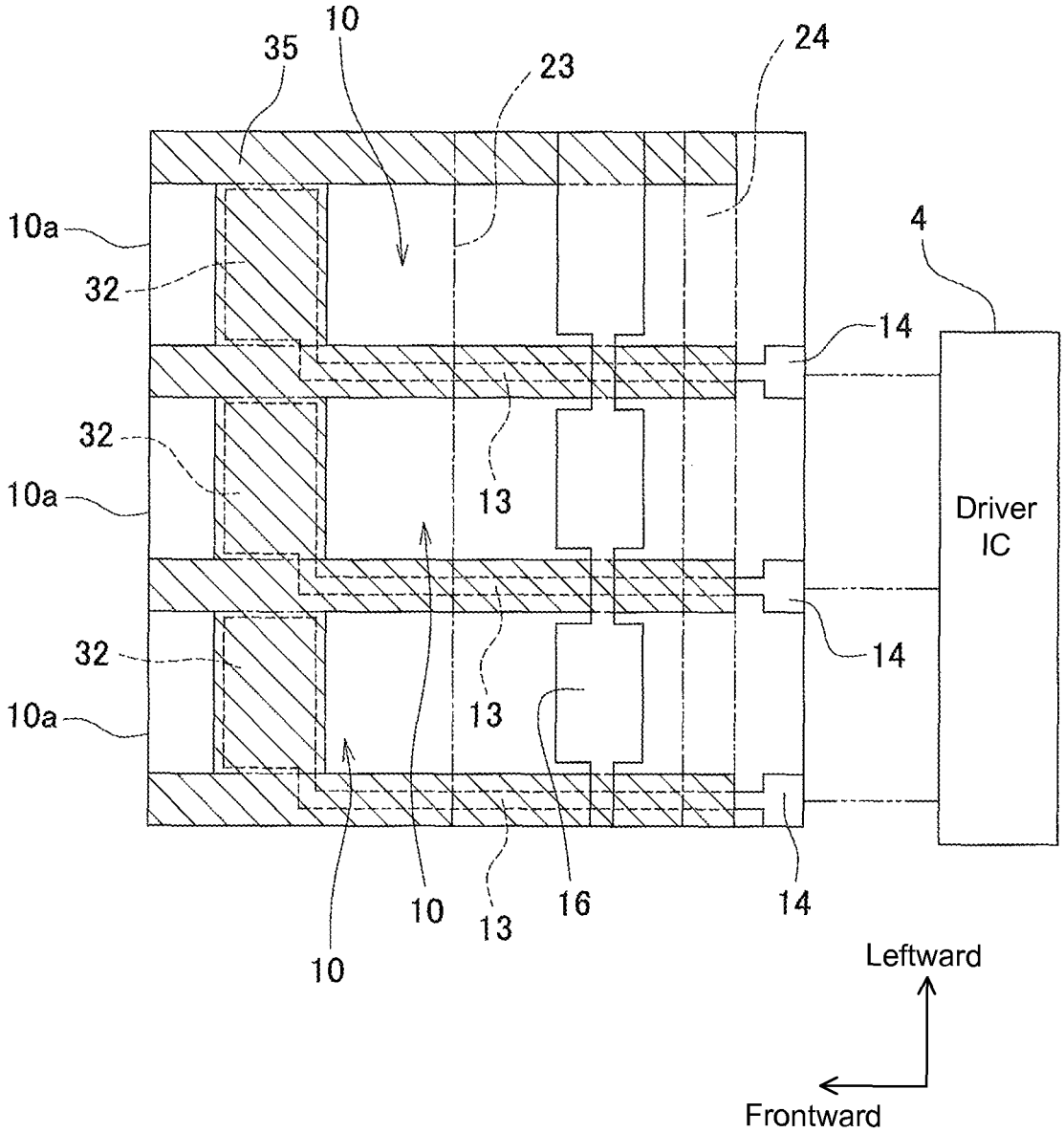
FIG. 6 is a plan view of a first modified illustrative embodiment, which corresponds to FIG. 3.

According to a modified illustrative embodiment, as shown in FIG. 6, individual electrodes 32 are disposed on the upper surface of the substrate 11 at positions slightly backward from the front end of the substrate 11, and an insulating layer 35 extends in the left-right direction so as to cover the individual electrodes 32 and also extends in the front-back direction in regions overlapping the regions located between adjacent individual ink flow passages 10. The insulating layer 35 is not disposed in regions of the individual ink flow passages 10 located in front of the individual electrodes 32 (first modified illustrative embodiment).

Figure 7A:
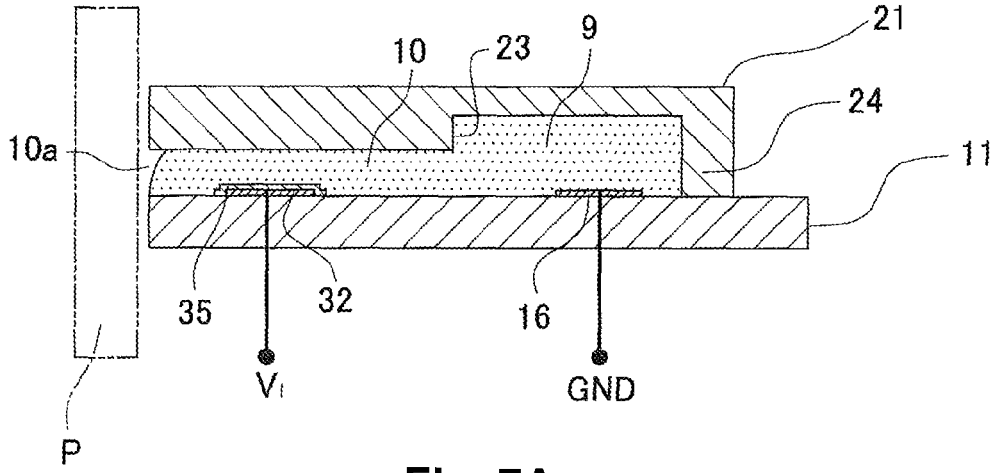
FIGS. 7A and 7B are sectional views of the first modified illustrative embodiment, which correspond to FIGS. 5A and 5B.

In such a case, as shown in FIG. 7A, when the ink is not discharged from the discharge port 10*a*, a drive potential VI is applied to the individual electrode 32, and the wetting angle of the ink on the surface of the insulating layer 35 in the regions facing the individual electrodes 32 is decreased. Thus, the ink is located in the common ink flow passage 9 and over the entire regions of the individual ink flow passages 10.

Figure 7B:
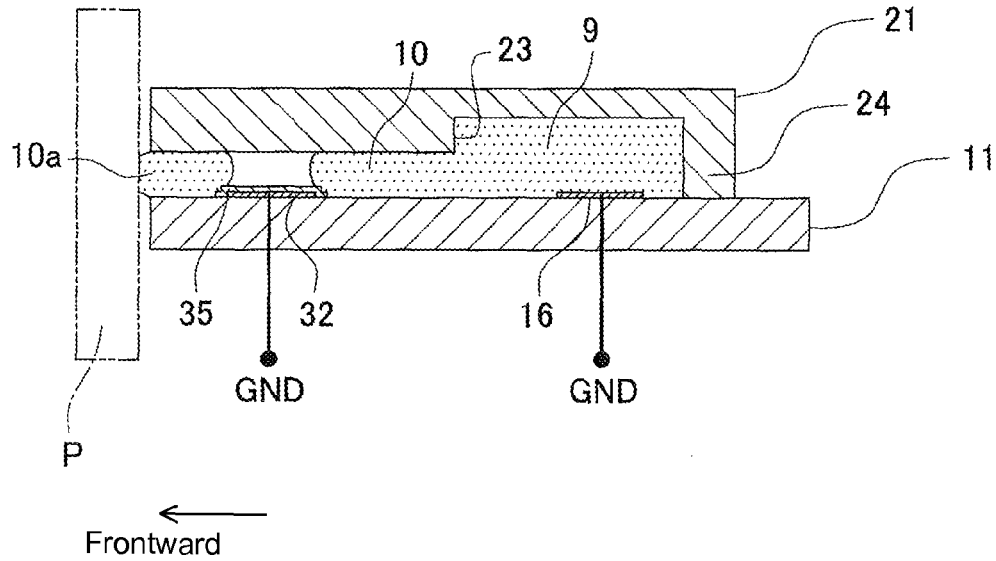

When the ink is discharged from the discharge port 10*a*, as shown in FIG. 7B, a ground potential is applied to an individual electrode 32 corresponding to the discharge port 10*a* from which the ink is to be discharged. As a result, the wetting angle of the ink on the surface of the insulating layer 35 in a region facing the individual electrode 32 is increased, and the ink in the individual ink flow passage 10 moves to regions in which the wetting angle of the ink on the surface is smaller and in which the insulating layer 35 is not disposed, i.e., moves forward and backward in the individual ink flow passage 10. The ink located in front of the region of the individual ink flow passage 10 facing the insulating layer 35 is pushed by the ink that has moved forward in the individual ink flow passage 10 and is discharged from the discharge port 10*a* to the recording sheet P.

In the first modified illustrative embodiment, a back pressure may be applied to the ink in the individual ink flow passage 10, the back pressure being smaller than the surface tension of the ink at the discharge port 10*a* when the ink is not discharged from the discharge port 10*a*. However, according to a further aspect, the ink tank 5 (refer to FIG. 1) is placed at substantially the same level as the common ink flow passage 9, and a back pressure is not applied to the ink in the individual ink flow passage 10.

Figure 8:
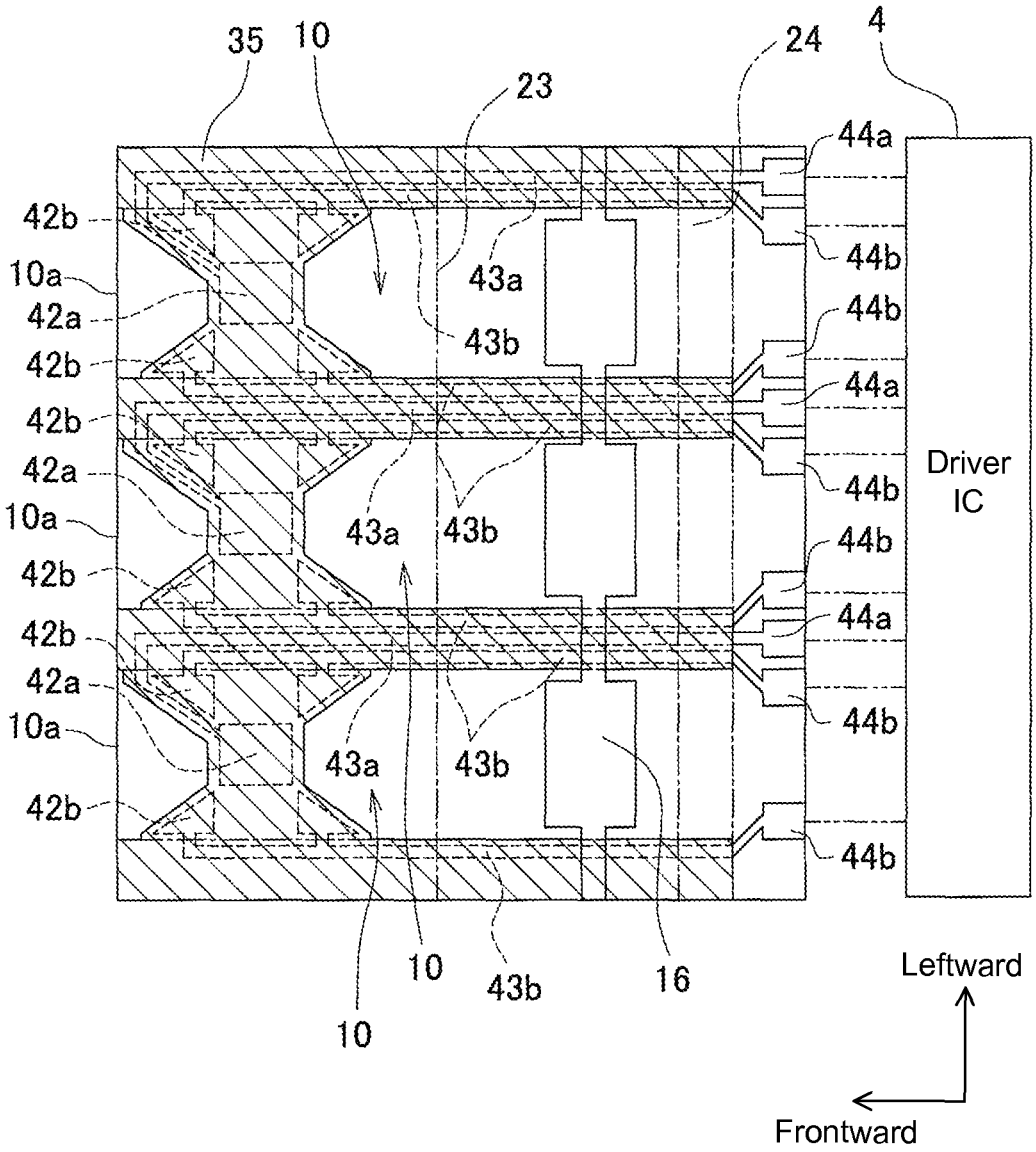
FIG. 8 is a plan view of a second modified illustrative embodiment, which corresponds to FIG. 3.

In another modified illustrative embodiment, as shown in FIG. 8, an individual electrode 42*a* is disposed slightly at the back of the front end of each individual ink flow passage 10 and in a central portion with respect to the front-back direction, the individual electrode 42*a* having a substantially rectangular planar shape. Individual electrodes 42*b*, each having a substantially right-angled triangular planar shape, are disposed outside the four comers of each individual electrode 42*a*. The individual electrodes 42*a* are connected to a driver IC 4 through wiring portions 43*a* and terminals 44*a*, and the individual electrodes 42*b* are connected to the driver IC 4 through wiring portions 43*b* and terminals 44*b* so that a ground potential or a drive potential VI can be selectively applied thereto (second modified illustrative embodiment).

Figure 9A:
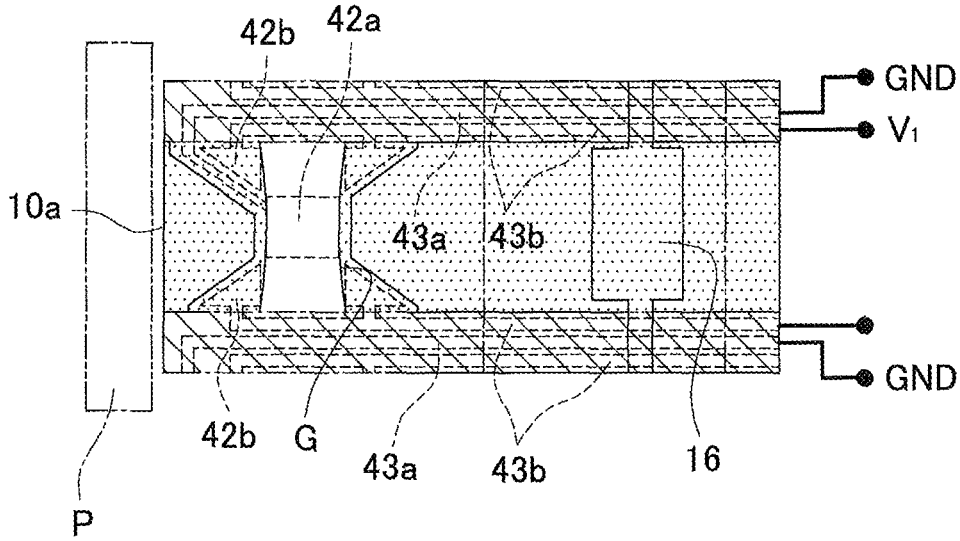
FIGS. 9A and 9B are plan views each showing an operation of an ink transport head according to the second modified illustrative embodiment.

In such a case, when the ink is not discharged, as shown in FIG. 9A, the ground potential is applied to the individual electrode 42*a* and the drive potential V1 is applied to the individual electrodes 42*b* by the driver IC 4. As a result, the wetting angle of the ink on the insulating layer 45 in regions facing the individual electrodes 42*b* is equal to or smaller than the critical wetting angle, and the wetting angle of the ink in the other region on the insulating layer 45 is larger than the critical wetting angle. Consequently, the ink is present only in a region facing the individual electrodes 42*b* in the section of the individual ink flow passage 10 facing the insulating layer 45. A bubble G is present in a region extending in the left-right direction including the region facing the individual electrode 42*a* in the section of the individual ink flow passage 10 facing the insulating layer 45. The ink in the individual ink flow passage 10 is blocked by the bubble G from flowing to the discharge port 10*a*.

Figure 9B:
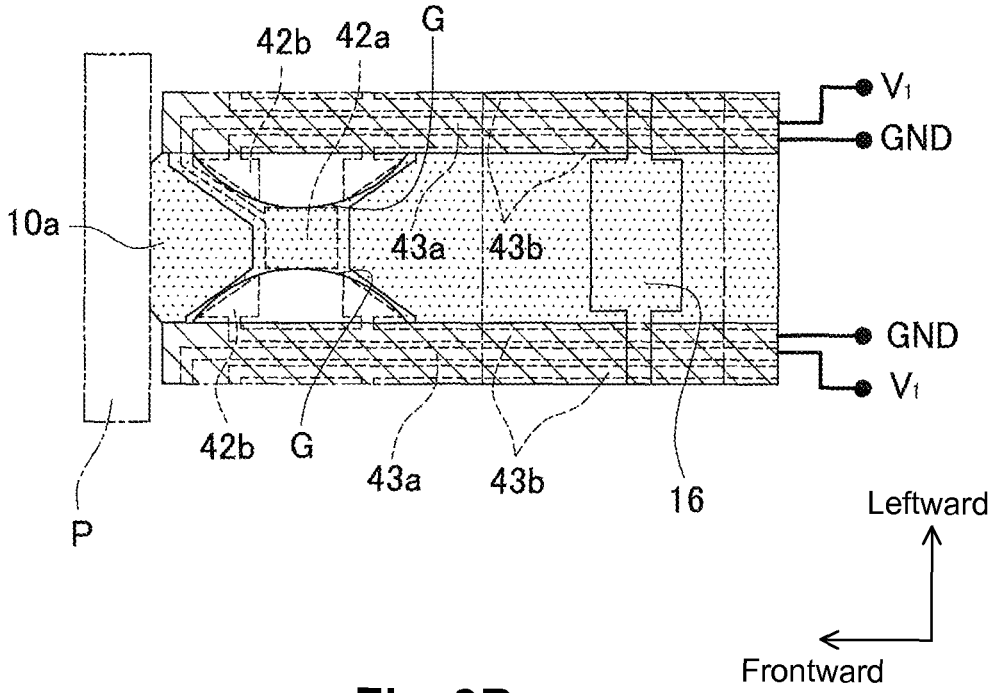

When the ink is discharged from the discharge port 10*a*, as shown in FIG. 9B, the drive potential V1 is applied to the individual electrode 42*a*, and the ground potential is applied to the individual electrodes 42*b*. As a result, the wetting angle of the ink on the insulating layer 45 in regions facing the individual electrodes 42*b* is larger than the critical wetting angle, and the wetting angle of the ink on the insulating layer 45 in a region facing the individual electrode 42*a* is equal to or smaller than the critical wetting angle. Consequently, the ink moves, and the ink is present on the insulating layer 45 only in the section facing the individual electrode 42*a* in the region where the individual ink flow passage 10 overlaps the insulating layer 45. The bubble G in the individual ink flow passage 10 also moves. As a result, bubbles G are present in two regions which are located at both sides in the left-right direction of the individual electrode 42*a* and which extend in the front-back direction including the regions facing the individual electrodes 42*b* in the section of the individual ink flow passage 10 facing the insulating layer 45. Thus, the ink in the individual ink flow passage 10 is not blocked by the bubbles G, and the ink is discharged from the discharge port 10*a* to the recording sheet P.

Figure 10:
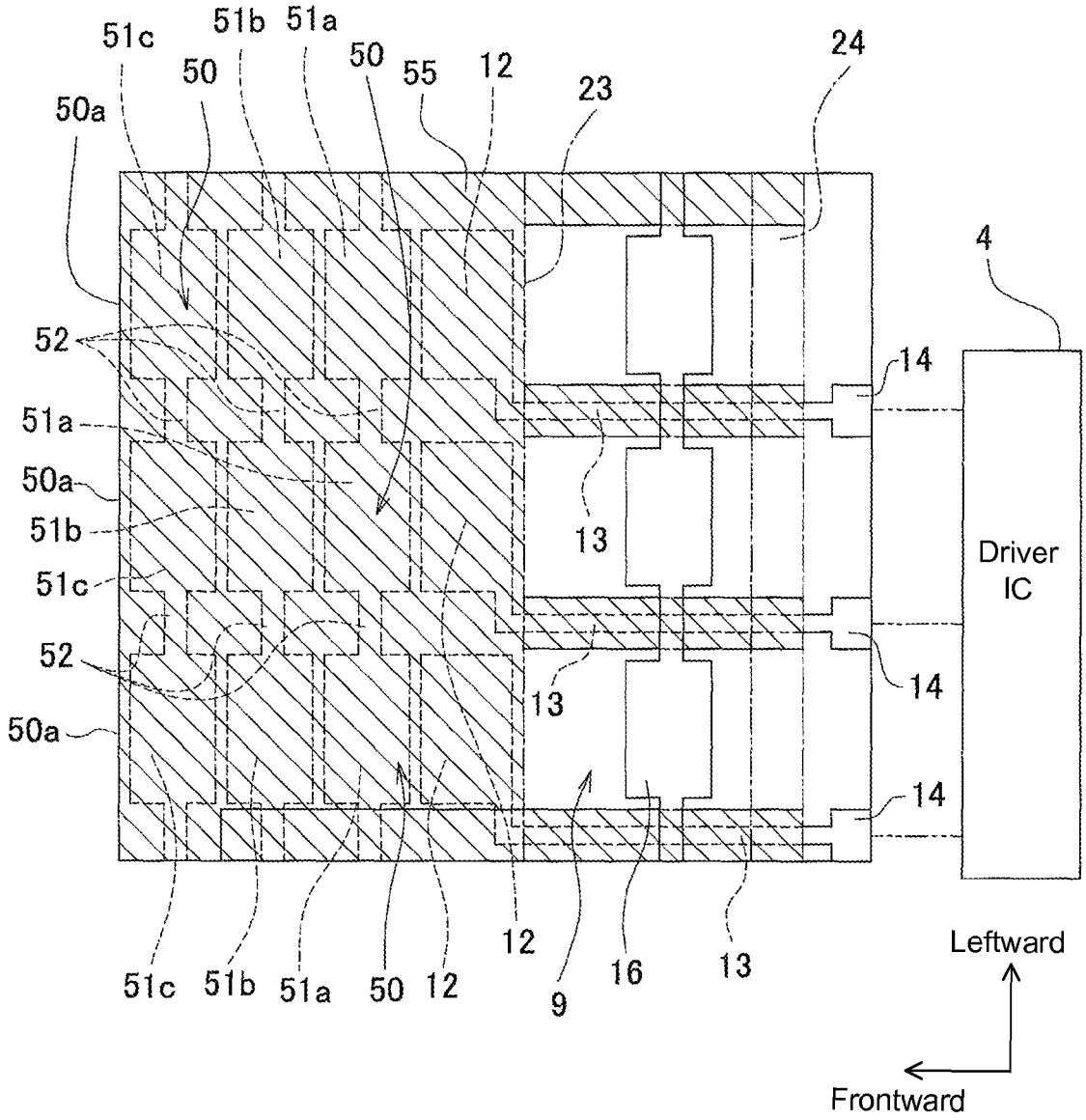
FIG. 10 is a plan view of a third modified illustrative embodiment, which corresponds to FIG. 3.

In another modified illustrative embodiment, as shown in FIG. 10, three electrodes 51*a*, 51*b*, and 51*c*, which are disposed a predetermined distance apart from each other in the front-back direction in front of the individual electrode 12, are provided in each of the individual ink flow passages 50. The electrodes 51*a*, the electrodes 51*b*, and the electrodes 51*c*, which are arrayed in the left-right direction, are connected to each other by corresponding wiring portions 52. An insulating layer 55 is continuously disposed in regions extending in the front-back direction between the adjacent individual ink flow passages 50 with respect to the left-right direction, and in regions overlapping the individual electrodes 12 and the electrodes 51*a* and 51*b*, and 51*c* with respect to the front-back direction. The electrodes 51*a*, 51*b*, and 51*c* are connected to the driver IC 4 by wires at positions not shown in the drawing, and are provided with either a drive potential V1 or a ground potential by the driver IC 4 (third modified illustrative embodiment).

Figure 11A:
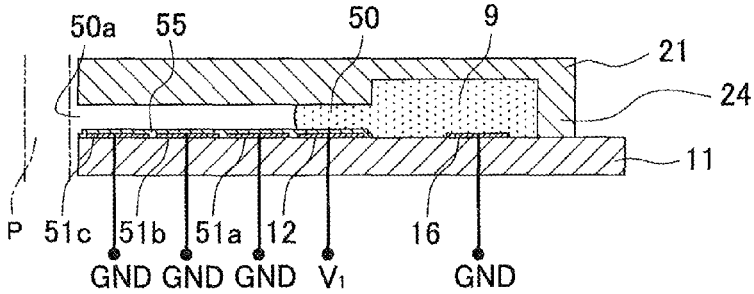
FIGS. 11A to 11D are sectional views each showing an operation of an ink transport head according to the third modified illustrative embodiment.

In such a case, when the ink is not discharged from the discharge port 50*a*, the ground potential is applied to each of the individual electrode 12 and the electrodes 5l*a*, 51*b*, and 51*c*. As in the first illustrative embodiment, the ink does not flow into a portion facing the insulating layer 55. In the process of discharging the ink, as in the first illustrative embodiment, as shown in FIG. 11A, when the drive potential V1 is applied to the individual electrode 12, the ink in the common ink flow passage 9 flows onto the insulating layer 55 in a portion facing the individual electrode 12.

Figure 11B:
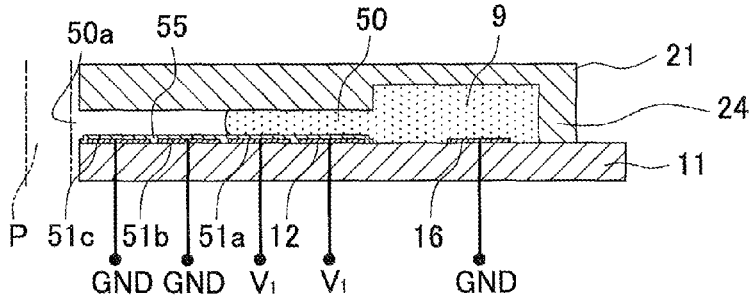
Figure 11C:
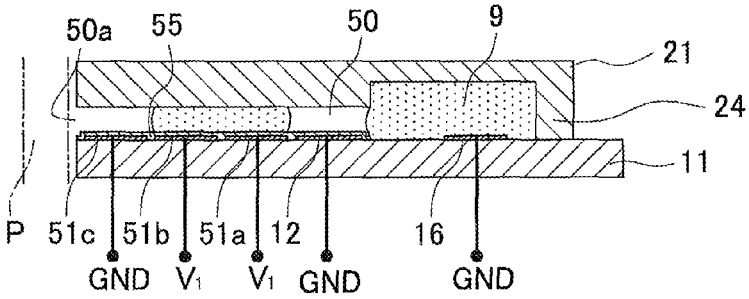

Next, as shown in FIG. 11B, when the drive potential V1 is applied to the electrode 51*a*, the ink further flows into a portion facing the electrode 51*a*. At the time when the ink flows into the portion facing the electrode 51*a*, as shown in FIG. 11C, by setting the electrical potential of the individual electrode 12 back to the ground potential, the ink located at the portion facing the individual electrode 12 moves in the front-back direction, and the ink located above the electrode 51 a is separated from the ink in the common ink flow passage 9.

Figure 11D:
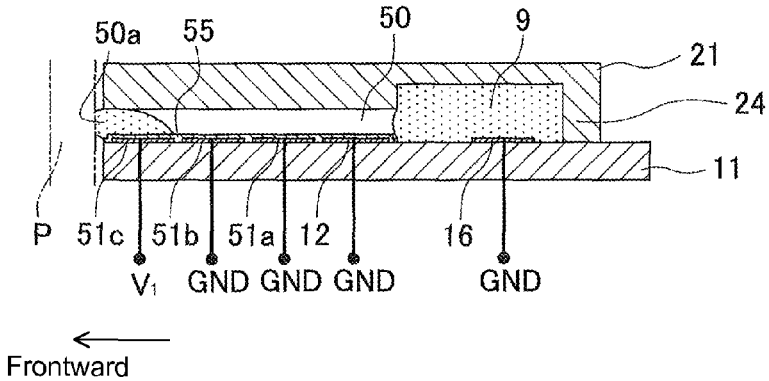

Then, the drive potential V1 is applied to the electrode 51*b*. At the time when the ink flows into a portion facing the electrode 51*b*, the electrical potential of the electrode 51*a* is set back to the ground potential. Then, the drive potential V1 is applied to the electrode 51*c*. At the time when the ink flows into a portion facing the electrode 51*c*, the electric potential of the electrode 51*b* is set back to the ground potential. Thereby, the ink moves to the portions facing the electrodes 51*b* and 51*c* successively. Finally, as shown in FIG. 11D, the ink is discharged from the discharge port 50*a* to the recording sheet P. In the third modified illustrative embodiment, the electrodes 51*a*, the electrodes 51*b*, and the electrodes 51*c*, which lie adjacent to each other in the left-right direction, are connected to each other by the corresponding wiring portions 52. However, an arrangement may be used in which these electrodes are not connected to each other and are individually connected to the driver IC 4.

Figure 12:
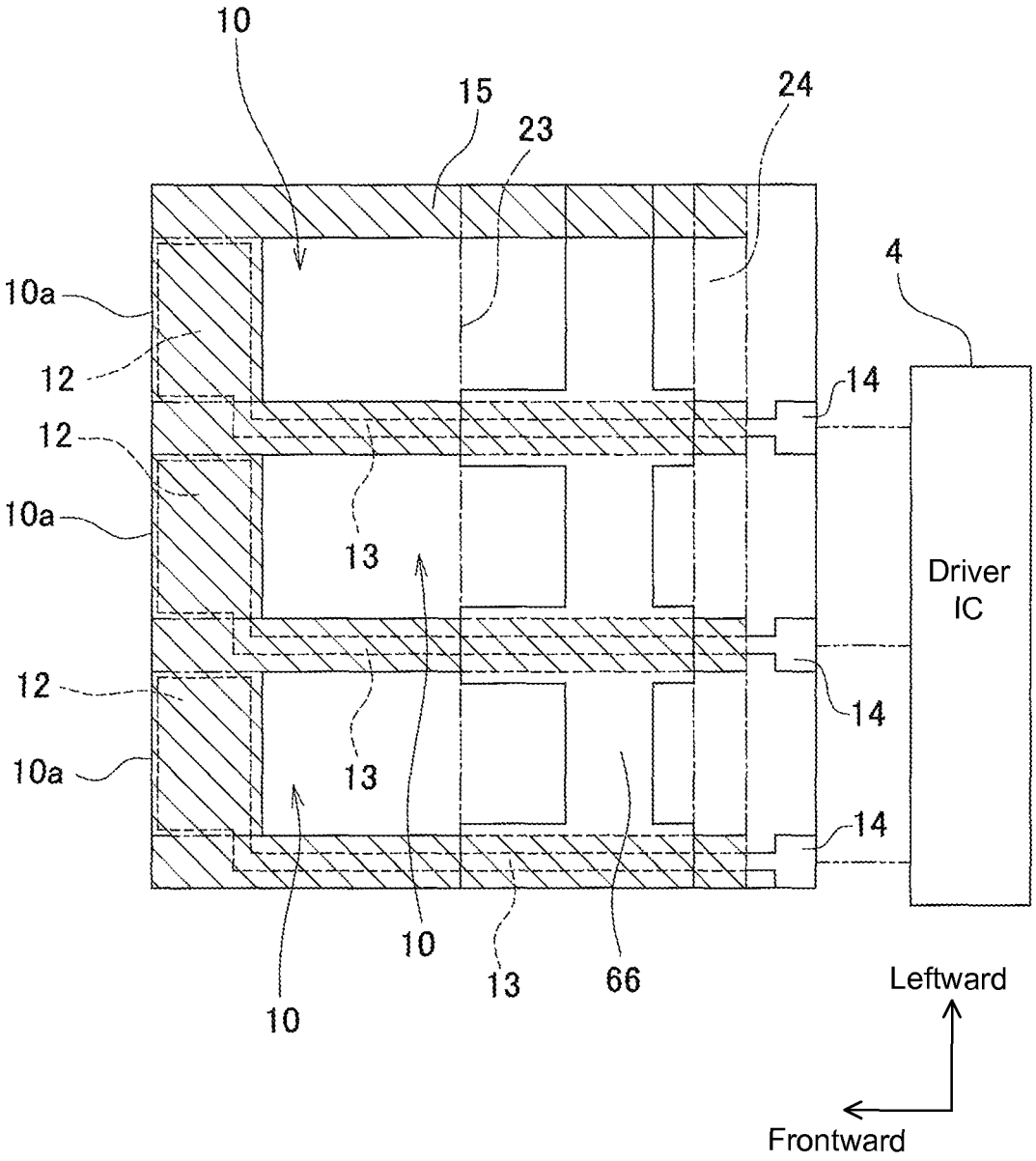
FIG. 12 is a plan view of a fourth modified illustrative embodiment, which corresponds to FIG. 3.

In another modified illustrative embodiment, as shown in FIG. 12, a common electrode 66 extends in the left-right direction. The common electrode 66 also extends in the front-back direction at positions overlapping regions between the adjacent individual ink flow passages 10 with respect to the left-right direction, and the common electrode 66 completely covers the insulating layer 15 in the common ink flow passage 9 (fourth modified illustrative embodiment). In such a case, in the common ink flow passage 9, portions of the insulating layer 15 covering the wiring portions 13 are not exposed. Consequently, even if the electrical potential of the wiring portions 13 is changed, and the wetting angle of the ink in the portions of the insulating layer 15 facing the wiring portions 13 is changed, the movement of the ink in the common ink flow passage 9 can be prevented from being affected by such a change.

Figure 13:
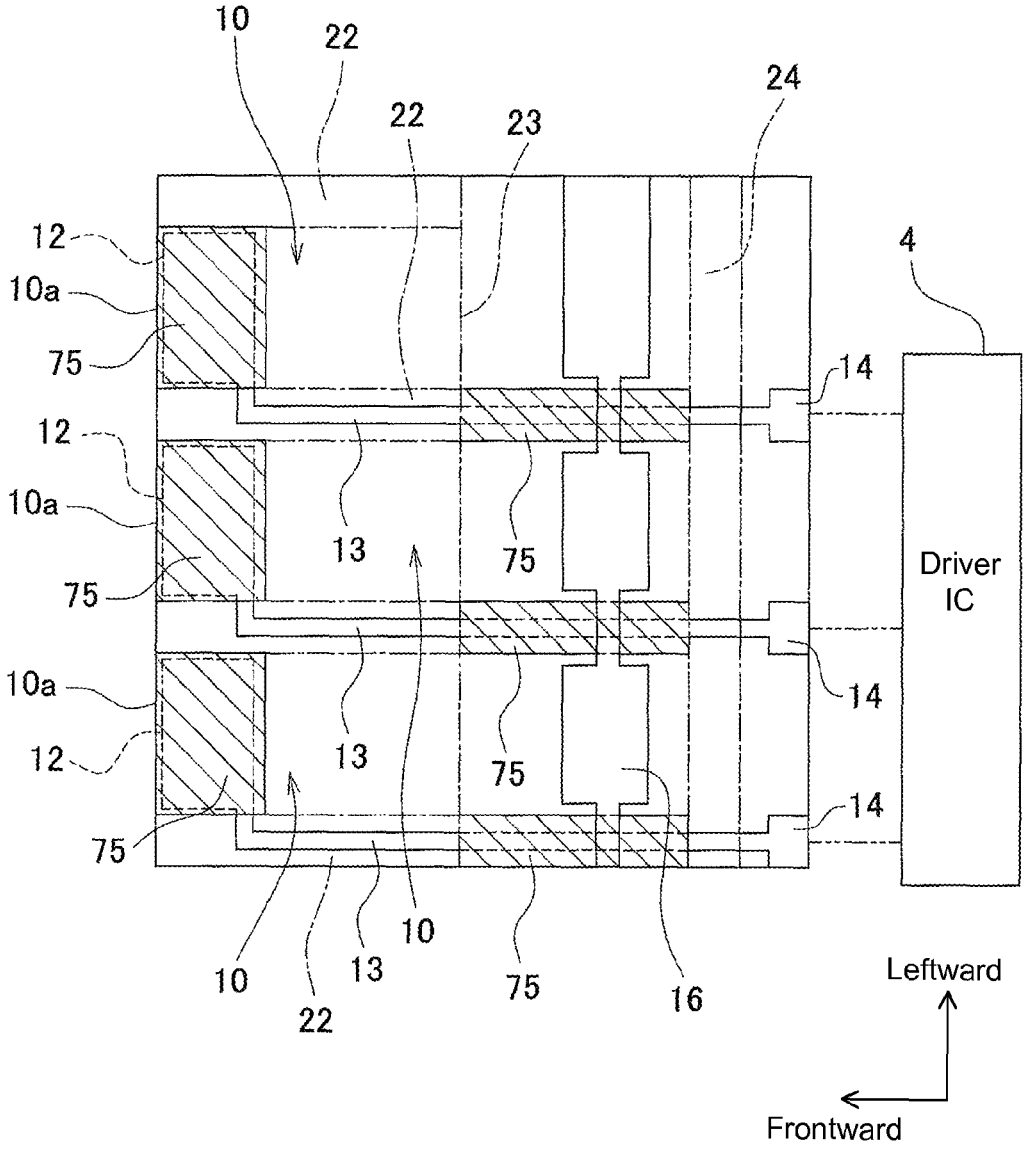
FIG. 13 is a plan view of a fifth modified illustrative embodiment, which corresponds to FIG. 3.

In another modified illustrative embodiment, as shown in FIG. 13, insulating layers 75 are disposed in regions overlapping the individual electrodes 12 in a plan view, and insulating layers 75 are disposed in parts overlapping the common ink flow passage 9 in a plan view in regions overlapping regions between the adjacent individual ink flow passages 10 with respect to the left-right direction, but insulating layers 75 are not disposed in parts facing the partition walls 22 in a plan view (fifth modified illustrative embodiment). Even in this case, since the wiring portions 13 disposed between the adjacent individual ink flow passages 10 are covered with the partition walls 22, the ink can be prevented from being brought into contact with the wiring portions 13.

Figure 14:
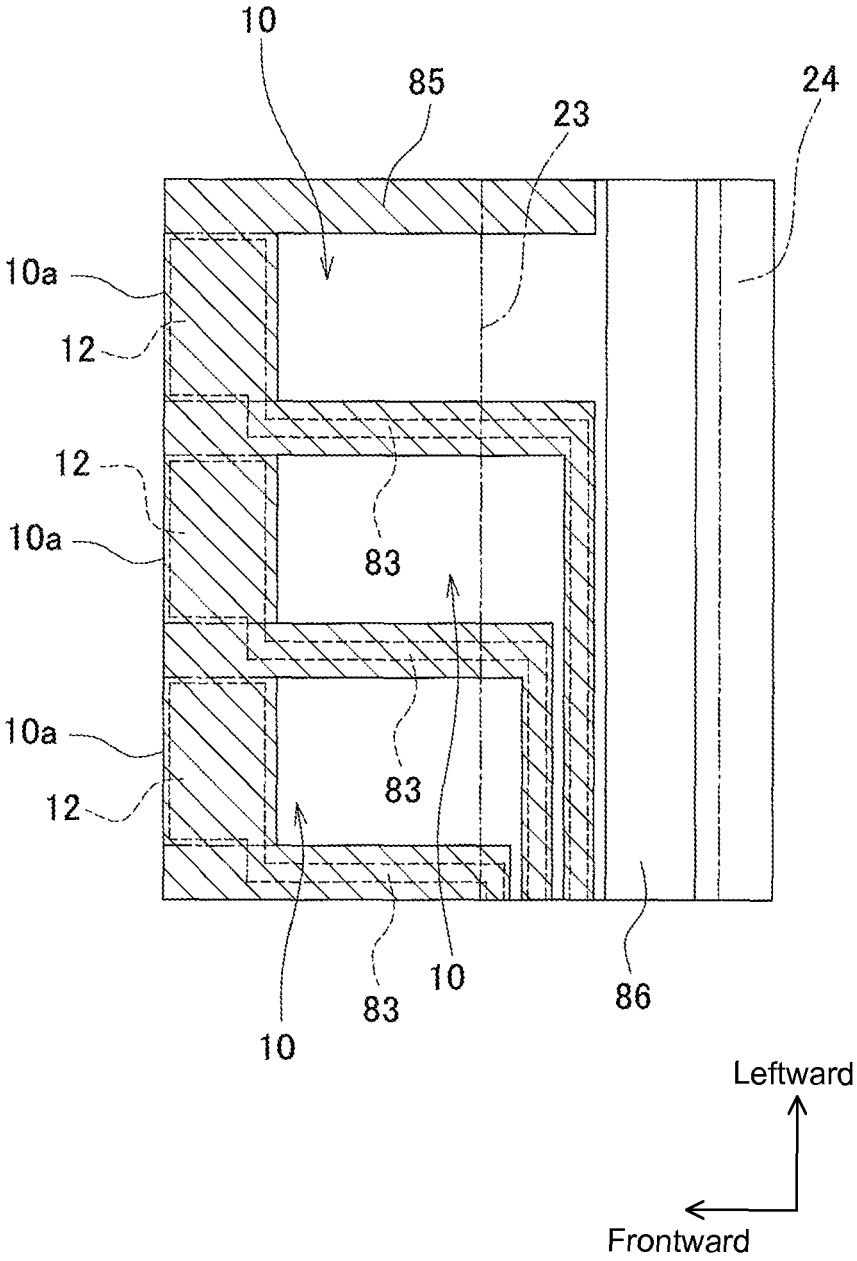
FIG. 14 is a plan view of a sixth modified illustrative embodiment, which corresponds to FIG. 3.

In another modified illustrative embodiment, as shown in FIG. 14, each of the wiring portions 83 extends rightward from the right back corner of the corresponding individual electrode 12 to a region between the adjacent individual electrodes 12. Each of the wiring portions 83 is bent substantially at a right angle toward the back, further extends to a region overlapping the common ink flow passage 9, then is bent substantially at a right angle toward the right, and extends further. Thus, the wiring portions 83 and a common electrode 86 do not intersect with each other. The common electrode 86 extends with a constant width in the left-right direction (sixth modified illustrative embodiment). Even in this case, the wiring portions 83 are connected to a driver IC at positions on the right side (not shown), and electrical potentials are applied to each of the individual electrodes 12 by the driver IC. In such a case, since the wiring portions 83 and the common electrode 86 do not overlap each other, it is possible to prevent an extra capacitance from occurring in the insulating layer 85. Furthermore, since the wiring portions 83 are arranged so as not to intersect with the common electrode 86, unlike the first illustrative embodiment, the width of the common electrode 86 does not need to be narrowed in any sections in order to decrease the capacitance in the insulating layer 85. Thus, the common electrode 86 can be formed easily.

A second illustrative embodiment of the present invention will now be described. The second illustrative embodiment relates to another example in which the present invention is applied to a printer that performs printing by transporting ink to a recording sheet. In a printer according to the second illustrative embodiment, the ink transport head 1 of the printer 100 shown in FIG. 1 is replaced with an ink transport head 101. The ink transport head 101 will be described below.

Figure 15:
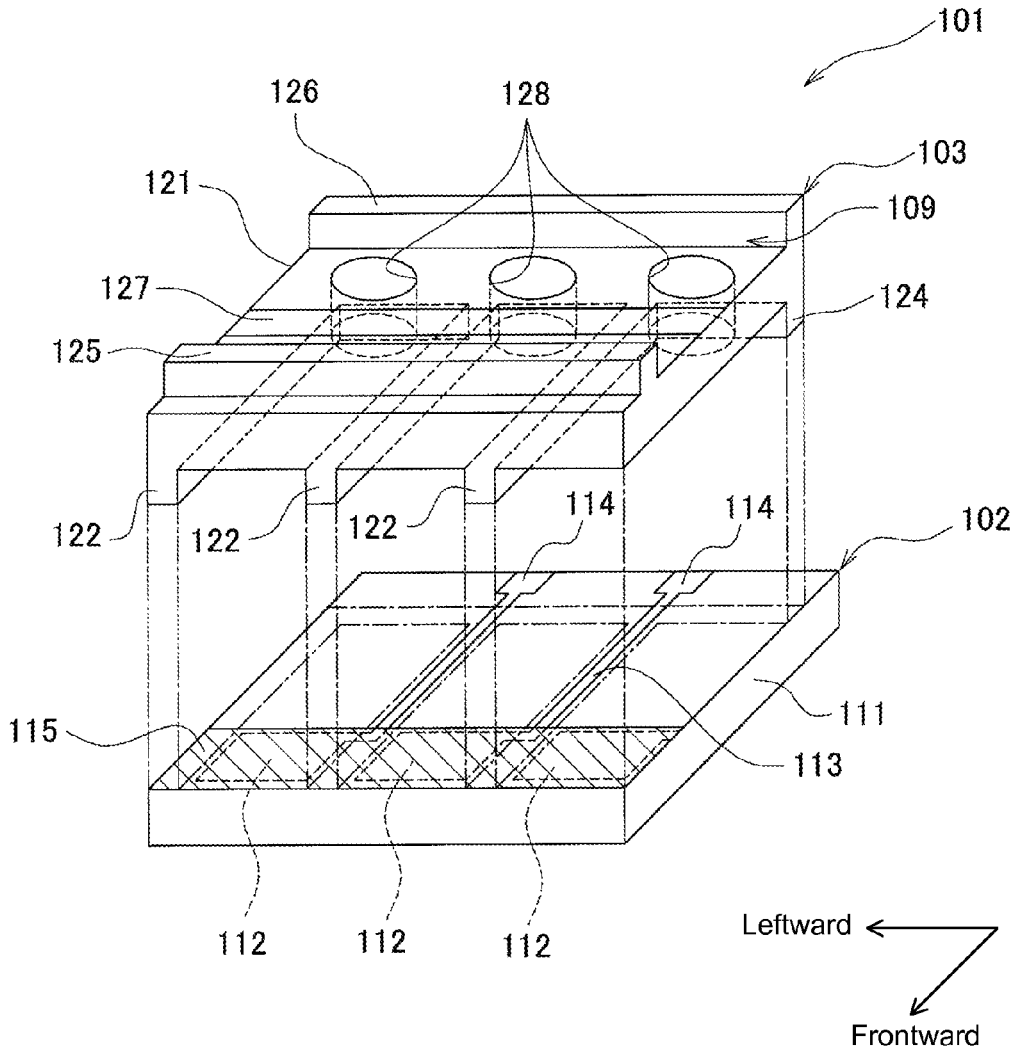
FIG. 15 is an exploded perspective view showing a part of an ink transport head according to a second illustrative embodiment, which corresponds to FIG. 2.
Figure 16:
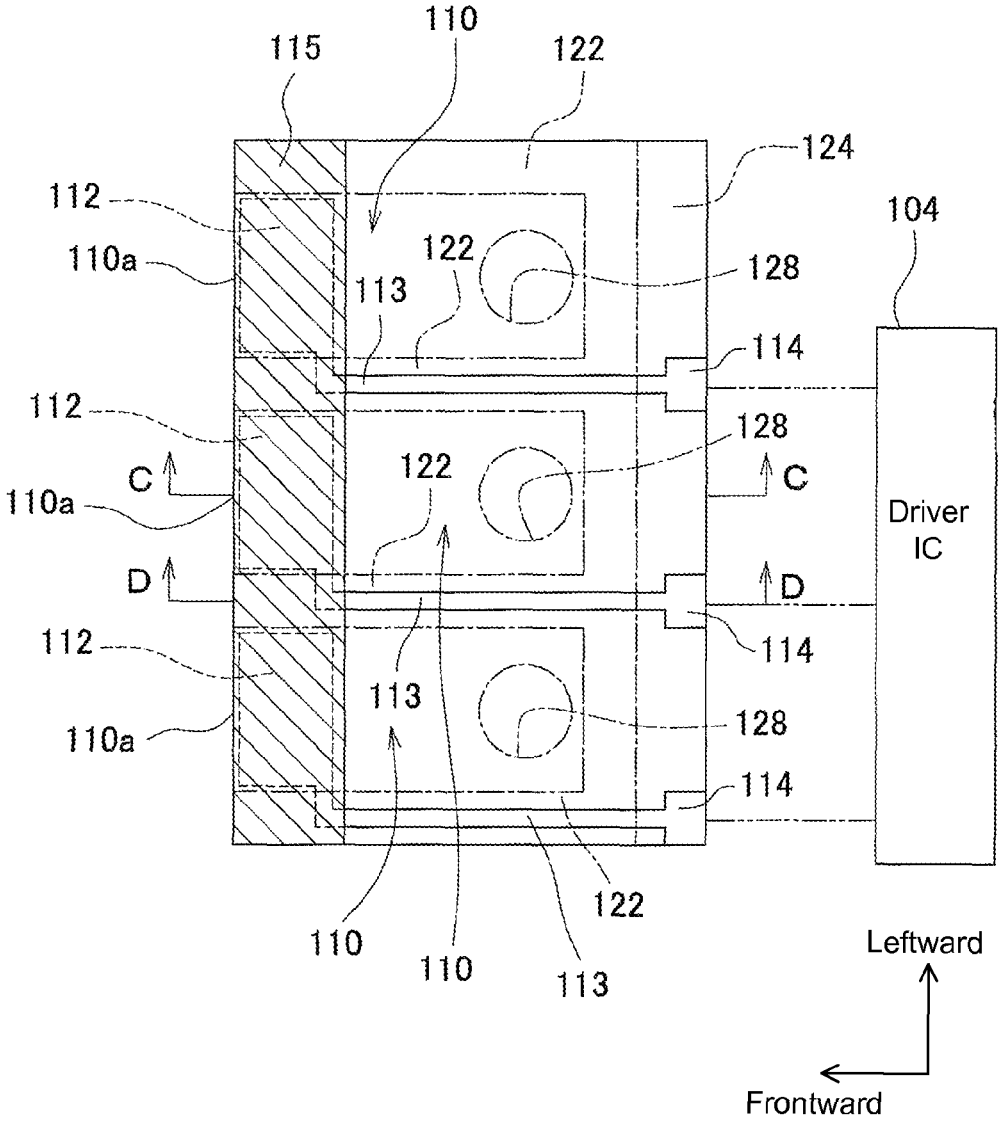
FIG. 16 is a plan view showing the ink transport head shown in FIG. 15.
Figure 17A:
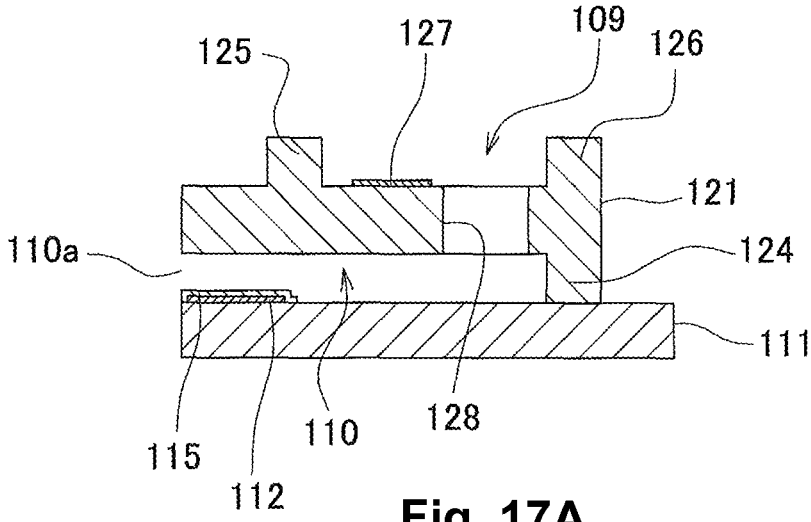
FIG. 17A is a sectional view taken along the line C-C of FIG. 16.
Figure 17B:
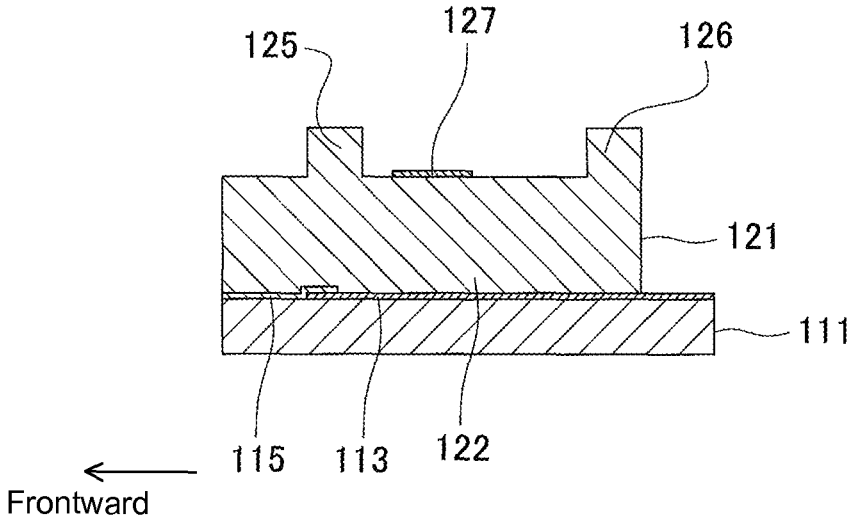
FIG. 17B is a sectional view taken along the line D-D of FIG. 16.

FIG. 15 is an exploded perspective view showing a part of the ink transport head 101 according to the second illustrative embodiment, which corresponds to FIG. 2. FIG. 16 is a plan view of FIG. 15. FIG. 17A is a sectional view taken along the line C-C of FIG. 16, and FIG. 17B is a sectional view taken along the line D-D of FIG. 16.

As shown in FIGS. 15 to 17B, the ink transport head 101 includes a lower member 102 constituting a substantially lower half portion and an upper member 103 constituting a substantially upper half portion. The lower member 102 and the upper member 103 are bonded to each other. Discharge ports 110*a* are disposed on the front end. Individual ink flow passages 110 extend in the front-back direction between the lower member 102 and the upper member 103, the individual ink flow passages 110 being spaced a predetermined distance apart from each other in the left-right direction. A common ink flow passage 109 extending in the left-right direction is disposed on the upper member 103. That is, the common ink flow passage 109 is disposed on a plane that is different from the upper surface of a substrate 111 on which the individual ink flow passages 110 are disposed.

The lower member 102 includes individual electrodes 112, wiring portions 113, terminals 114, and an insulating layer 115 disposed on an upper surface of the substrate 111. The substrate 111 is a plate-like body which has a substantially rectangular planar shape and is a substrate having at least one insulating surface, for example, a silicon substrate having an oxidized surface, or a substrate composed of an insulating material such as polyimide or alumina.

The individual electrodes 112 each have a substantially rectangular planar shape and are disposed a predetermined distance apart from each other in the left-right direction on the front end of the upper surface of the substrate 111 so as to correspond to the individual ink flow passages 110.

Each of the wiring portions 113 extends rightward from the right back corner of the corresponding individual electrode 112 to a region between the adjacent individual electrodes 112. Each wiring portion 113 is bent substantially at a right angle toward the back, and extends to a terminal 114 disposed on the back end of the upper surface of the substrate 111. Since the common ink flow passage 109 is disposed on a plane that is different from the upper surface of the substrate 111, it is not necessary to arrange the wiring portions 113 as to avoid the common ink flow passage 109. As a result more arrangement configurations of the wiring portions 113 may exist.

The terminals 114 each have a substantially rectangular planar shape and are disposed on the back end of the substrate 111 at positions overlapping the wiring portions 113 in a plan view. The terminals 114 are connected to a driver IC 104 as shown in FIG. 16. A drive potential V1 or a ground potential is selectively applied by the driver IC 104 to each of the individual electrodes 112 through the terminals 114 and the wiring portions 113. According to such an arrangement, since the wiring portions 113 extend toward the upstream side in the transport direction of ink in the individual ink flow passages 110 and the terminals 114 are disposed on the back end of the substrate 111, even when many individual electrodes 112 are highly integrated, it is possible to connect the driver IC 104 to the terminals 114 disposed on the back end of the substrate 111. Note that the driver IC 104 may be disposed on the back end of the upper surface of the substrate 111 and not directly connected to the terminals 114, and may be connected to the terminals 114 through a flexible printed circuit board (FPC) or the like (not shown).

The individual electrodes 112, the wiring portions 113, and the terminals 114 are each composed of a conductive material, such as a metal, and can be formed by screen-printing, sputtering, vapor deposition, or the like. Since all of the individual electrodes 112, the wiring portions 113, and the terminals 114 are disposed on the upper surface of the substrate 111, these components can be connected to each other on the upper surface of the substrate 111. Consequently, it is not necessary to form through-holes in the substrate 111 in order to connect these components to each other. Thus, the structure of the ink transport head 101 can be simplified, and the manufacturing cost can be reduced. Furthermore, since all of the individual electrodes 112, the wiring portions 113, and the terminals 114 are disposed on the upper surface of the substrate 111, these components can be formed at one time by the method described above.

The insulating layer 115 is composed of an insulating material, such as a fluorocarbon resin, that is different from the substrate 111. The insulating layer 115 extends in the left-right direction at the front end on the upper surface of the substrate 111 so as to cover the individual electrodes 112. The insulating layer 115 can be formed by a method in which an insulating material is applied by spin coating to the entire region of the upper surface of the substrate 111, and then unnecessary portions are removed by laser. Alternatively, a method may be employed in which a mask is applied to the upper surface of the substrate 111, and the insulating layer 115 is formed by CVD, or a method may be employed in which an insulating material is applied by coating onto the upper surface of the substrate 111 to form the insulating layer 115.

The upper member 103 includes partition walls 122 and a partition wall 124 disposed on a lower surface of a substrate 121, and partition walls 125 and 126 and a common electrode 127 disposed on an upper surface of the substrate 121. Through-holes 128 passing through the substrate 121 are disposed. The substrate 121 is a plate-like body which has a substantially rectangular planar shape with a length with respect to the front-back direction being slightly smaller than that of the substrate 111. The substrate 121 is composed of the same insulating material as the substrate 21.

The partition walls 122 protrude downward from regions of the lower surface of the substrate 121 overlapping regions between adjacent individual ink flow passages 110 in a plan view, and extend from the front end of the substrate 121 in the front-back direction to the vicinity of the back end. The partition wall 124 protrudes downward in a plan view from the back end of the lower surface of the substrate 121 to a position at the same level as the lower end of each partition wall 122 and extends with a length substantially equal to the overall length of the substrate 121 with respect to the left-right direction. The back ends of the partition walls 122 are connected to the partition wall 124 and the partition walls 122 and the partition wall 124 are integrated with each other. When the lower member 102 and the upper member 103 are bonded to each other, spaces surrounded by the upper surface of the substrate 111, the lower surface of the substrate 121, the partition walls 122, and the partition wall 124 serve as the individual ink flow passages 110.

The partition wall 125 protrudes upward from the vicinity of the front end of the upper surface of the substrate 121 and extends with a length substantially equal to the overall length of the substrate 121 with respect to the left-right direction. The partition wall 126 protrudes upward from the back end of the upper surface of the substrate 121 and extends with a length substantially equal to the overall length of the substrate 121 with respect to the left-right direction. A space surrounded by the upper surface of the substrate 121, the partition walls 125 and 126, and a member (not shown) located above the substrate 121 serves as the common ink flow passage 109.

The common electrode 127 extends on the upper surface of the substrate 121 in a region between the partition wall 125 and the partition wall 126, with a length substantially equal to the overall length of the substrate 121 with respect to the left-right direction. That is, the common electrode 127 is disposed on the bottom surface of the common ink flow passage 109. The common electrode 127 is connected to the driver IC 104 at a position not shown, and the common electrode 127 is maintained at ground potential by the driver IC 104. Thus, the ink in the common ink flow passage 109 is maintained at ground potential. The common electrode 127 is composed of the same conductive material as each of the individual electrodes 112, the wiring portions 113, and the terminals 114 and similarly can be formed by screen-printing, sputtering, vapor deposition, or the like.

The through-holes 128 each have a substantially circular planar shape and are disposed between the common electrode 127 and the partition wall 126 at positions overlapping the central portions of the individual ink flow passages 110 in a plan view with respect to the left-right direction. The through-holes 128 vertically pass through the substrate 121, and the common ink flow passage 109 communicate with the individual ink flow passages 110 through the through-holes 128. Thus, the ink in the common ink flow passage 109 is supplied to the individual ink flow passages 110. Since the common ink flow passage 109 communicates with the individual ink flow passages 110, the ink in the individual ink flow passages 110 is maintained at ground potential.

A process in which ink is discharged to a recording sheet P by the ink transport head 101 will now be described with reference to FIGS. 18A and 18B, which are sectional views, each showing an operation of the ink transport head 101.

Figure 18A:
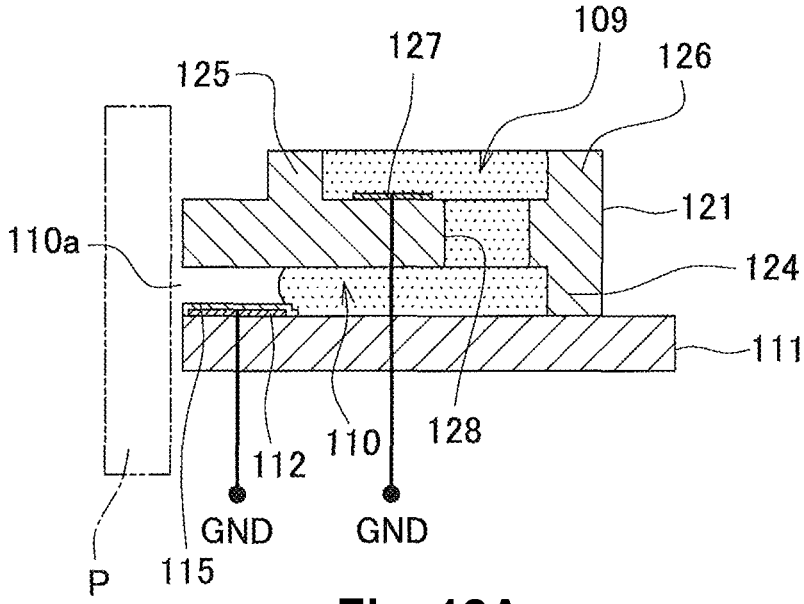
FIGS. 18A and 18B are sectional views each showing an operation of the ink transport head shown in FIG. 16.

In the ink transport head 101, when the ink is not discharged from the discharge port 110*a*, as shown in FIG. 18A, a ground potential is applied to the individual electrode 112, and there is no electrical potential difference between the individual electrode 112 and the ink in the individual ink flow passage 110, the ink being maintained at ground potential. At this time, the wetting angle of the ink on the surface of the insulating layer 115 is larger than the wetting angle of the ink on the upper surface of the substrate 111 and is larger than a wetting angle (critical wetting angle) of the insulating layer 115 at which the ink can move from a portion of the individual ink flow passage 110 where the substrate 111 is exposed to a portion of the individual ink flow passage 110 where the insulating layer 115 is disposed. Consequently, the meniscus of the ink in the individual ink flow passage 110 stops at the edge of the insulating layer 115 along the substrate 111, and the ink does not flow into a portion of the individual ink flow passage 110 facing the insulating layer 115. Thus, the ink is not discharged from the discharge port 110*a*.

Figure 18B:
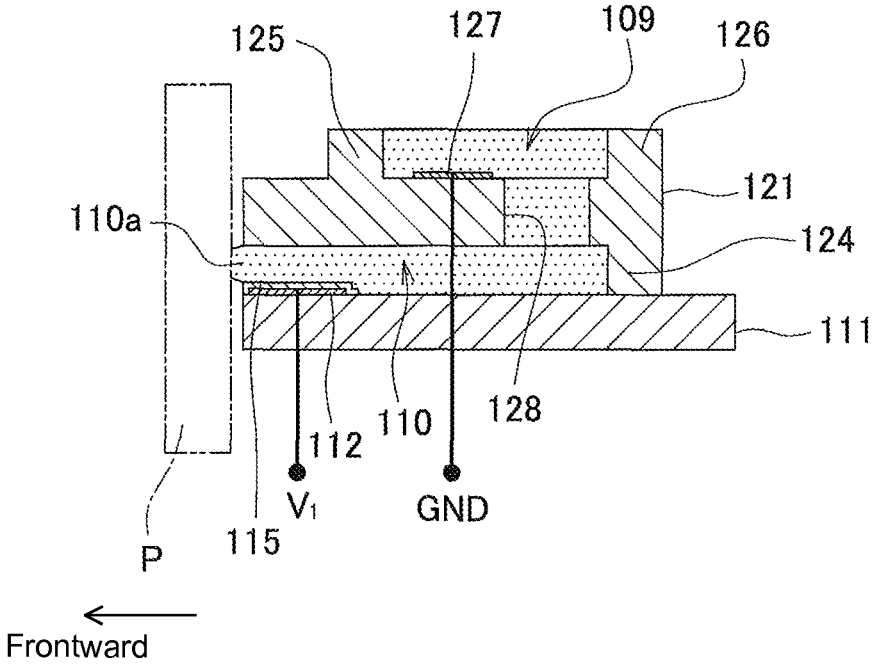

On the other hand, when the ink is discharged from the discharge port 110*a*, as shown in FIG. 18B, a drive potential V1 is applied to the individual electrode 112. As a result, an electrical potential difference occurs between the individual electrode 112 and the ink in the individual ink flow passage 110, and the wetting angle of the ink at the surface of the insulating layer 115 in the region facing the individual electrode 112 is decreased to a value equal to or less than the critical wetting angle. Consequently, the ink flows into a portion of the individual ink flow passage 110 facing the insulating layer 115, and the ink is discharged from the discharge port 110*a* to the recording sheet P.

At this time, since the ink in the individual ink flow passage 110 is maintained at ground potential by the presence of the common electrode 127, the electrical potential difference between the ink in the individual ink flow passage 110 and the individual electrode 112 does not easily change, thus enabling stable operation.

According to the second illustrative embodiment described above, since the common ink flow passage 109 and the individual ink flow passages 110 are disposed on the different planes, it is not necessary to arrange the wiring portions 113 so as to avoid the common ink flow passage 109. As a result more arrangement configurations of the wiring portions 113 may exist.

Furthermore, since all of the individual electrodes 112, the wiring portions 113, and the terminals 114 are disposed on the upper surface of the substrate 111, these components can be connected to each other on the upper surface of the substrate 111. Consequently, it is not necessary to form through-holes in the substrate 111 in order to connect these components. Thus, it is possible to simplify the structure of the ink transport head 101, and the manufacturing cost can be reduced.

Furthermore, since the wiring portions 113 extend through the regions between the individual ink flow passages 110 to the terminals 114 and since the wiring portions 113 are covered with the partition walls 122, the ink in the individual ink flow passages 110 can be prevented from being brought into contact with the wiring portions 113.

Furthermore, since the common electrode 127 is disposed in the common ink flow passage 109, the ink in the common ink flow passage 109 and the ink in the individual ink flow passage 110 can be maintained at ground potential. Consequently, the electrical potential difference between the ink in the individual ink flow passage 110 and the individual electrode 112 does not easily change, thus enabling stable operation.

Modified illustrative embodiments in which various modifications are made to the second illustrative embodiment will be described below. The same reference numerals are used to designate components having a similar structure as the structure of the components in the second illustrative embodiment, and the descriptions thereof are omitted.

Figure 19:
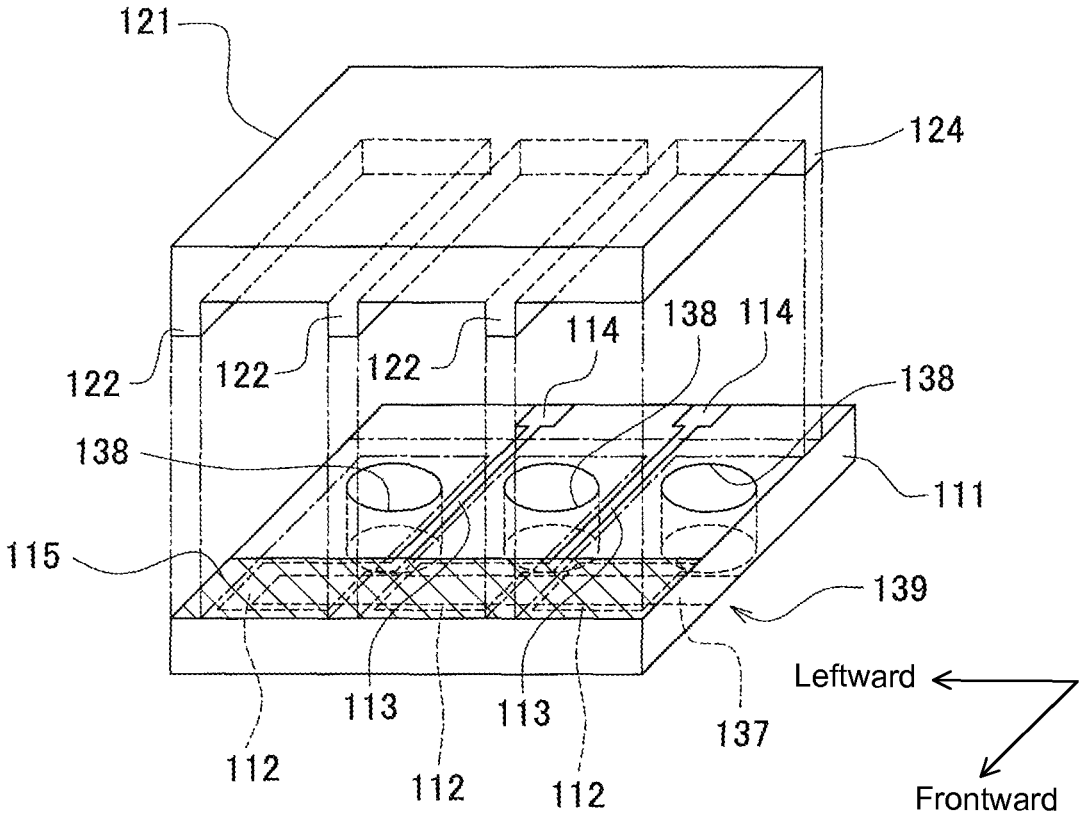
FIG. 19 is an exploded perspective view of a seventh modified illustrative embodiment, which corresponds to FIG. 15.

In the second illustrative embodiment, the common ink flow passage 109 is disposed above the individual ink flow passages 110. However, the common ink flow passage may be disposed below the individual ink flow passages 110 on a plane different from the plane on which the individual ink flow passages 110 are disposed. For example, according to a modified illustrative embodiment, as shown in FIG. 19, through-holes 138 each having a substantially circular planar shape are disposed in the vicinity of the back end of the individual ink flow passages 110 in a plan view so as to pass through the substrate 111. A common electrode 137 is disposed on the lower surface of the substrate 111. A space delimited by the substrate 111 and a member (not shown) located below the substrate 111, in which the lower surface of the substrate 111 corresponds to a ceiling plane, serve as a common ink flow passage 139 (seventh modified illustrative embodiment). Even in this case, the ink in the common ink flow passage 139 flows into individual ink flow passages 110, and is discharged from the discharge ports 110*a* in the same manner as in the second illustrative embodiment.

In the second illustrative embodiment, as in the first, second, and sixth modified illustrative embodiments of the first illustrative embodiment, the arrangements of the individual electrodes, the wiring portions, and the terminals can be changed, and a structure is also possible in which electrodes that are similar to the electrodes 51*a*, 51*b*, and 51*c* (refer to FIG. 10) according to the third modified illustrative embodiment of the first illustrative embodiment are provided.

In the first illustrative embodiment, the common electrode 16 is disposed in the common ink flow passage 9, and in the second illustrative embodiment, the common electrode 127 is disposed in the common ink flow passage 109. However, a structure may be used in which a common electrode is not disposed in a common liquid passage. Furthermore, a structure may be used in which a common ink flow passage is not provided and ink is supplied directly from an ink tank to individual ink flow passages.

Furthermore, the recording sheet P is not limited to paper and may be a glass substrate, a silicon substrate, a resin film, or the like. The shape of the recording sheet P may be cylindrical instead of planar. In the first and second illustrative embodiments, the substrate 11 and the substrate 111 are each composed of an insulating material. However, the material is not limited thereto. A substrate 11 or 111 having at least an upper insulating surface can be used. For example, a substrate composed of a conductive material on an upper surface of which a layer made of an insulating material is disposed may be used.

In the first and second illustrative embodiments, examples in which the present invention is applied to an ink transport head which transports ink have been described. Aspects of the present invention can be applied to a liquid transport apparatus which transports a conductive liquid other than ink, such as a reagent, a bio-solution, a wiring material solution, an electronic material solution, a cooling medium, or a fuel.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A liquid transport apparatus comprising:

a substrate having a planar insulating surface;

a plurality of liquid transport channels disposed on the planar insulating surface of the substrate and in each of which a conductive liquid is transported;

a plurality of electrodes having a surface contacting and disposed on the planar insulating surface of the substrate in regions corresponding to respective ones of the liquid transport channels;

a plurality of wiring portions each having a terminal at an end thereof, and each wiring portion coupled to the surface of a corresponding one of the electrodes and extending from the surface along the planar insulating surface of the substrate between adjacent liquid transport channels to the terminal;

an insulating layer, which is disposed so as to cover the plurality of electrodes, having a surface in which the liquid repellency changes according to an electrical potential difference between the conductive liquid and the electrodes; and a potential applying unit which applies an electric potential to each of the plurality of electrodes through each terminal provided on the plurality of wiring portions.

2. The liquid transport apparatus according to claim 1, wherein portions of the plurality of wiring portions disposed between the liquid transport channels are covered by the insulating layer.

3. The liquid transport apparatus according to claim 1, wherein each of two adjacent liquid transport channels is separated by a partition wall, and portions of each wiring portion disposed between the two adjacent liquid transport channels are covered with the partition wall.

4. The liquid transport apparatus according to claim 1, further comprising a common liquid passage which supplies the conductive liquid to each of the plurality of liquid transport channels.

5. The liquid transport apparatus according to claim 4, wherein the common liquid passage is disposed on a plane that is different from the insulating planar surface of the substrate on which the plurality of liquid transport channels is disposed.

6. The liquid transport apparatus according to claim 5, wherein a common electrode which is maintained at a predetermined electrical potential is disposed on a surface of the common liquid passage.

7. The liquid transport apparatus according to claim 4, wherein the common liquid passage is disposed on the planar insulating surface of the substrate;

the plurality of wiring portions extending from the plurality of electrodes to each terminal pass through the common liquid passage; and the plurality of wiring portions is covered with the insulating layer in the common liquid passage.

8. The liquid transport apparatus according to claim 7, wherein a common electrode maintained at a predetermined electrical potential is disposed in a region constituting a surface of the common liquid passage; and the plurality of wiring portions covered with the insulating layer and passing through the common liquid passage intersects with the common electrode.

9. The liquid transport apparatus according to claim 8, wherein, in sections where the plurality of wiring portions intersects with the common electrode, the length of the common electrode in a direction in which the wiring portions extend is less than the length of the common electrode in the direction in sections where the plurality of wiring portions does not intersect with the common electrode.

10. The liquid transport apparatus according to claim 8, wherein the common electrode completely covers the insulating layer in the common liquid passage.

* * * * *